US011072478B2

(12) United States Patent
Borrero et al.

(10) Patent No.: US 11,072,478 B2
(45) Date of Patent: Jul. 27, 2021

(54) FLEXIBLE PACKAGE

(71) Applicant: The Procter & Gamble Company, Cincinnati, OH (US)

(72) Inventors: Susana E Borrero, Mason, OH (US); Kenneth Stephen McGuire, Montgomery, OH (US); Lee Mathew Arent, Fairfield, OH (US); Benjamin G Hesford, Cincinnati, OH (US); Jun You, West Chester, OH (US); Jason M Earl, Milford, OH (US); Joseph Craig Lester, Liberty Township, OH (US); Benjamin Jacob Clare, Hamilton, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 131 days.

(21) Appl. No.: 16/515,317

(22) Filed: Jul. 18, 2019

(65) Prior Publication Data

US 2020/0024049 A1 Jan. 23, 2020

Related U.S. Application Data

(60) Provisional application No. 62/701,273, filed on Jul. 20, 2018, provisional application No. 62/783,535, (Continued)

(51) Int. Cl.
*B65D 81/02* (2006.01)
*B65D 81/05* (2006.01)

(Continued)

(52) U.S. Cl.
CPC ..... *B65D 81/022* (2013.01); *B65B 5/02* (2013.01); *B65B 31/04* (2013.01); *B65B 43/08* (2013.01);

(Continued)

(58) Field of Classification Search
CPC .... B65D 81/022; B65D 81/052; B65D 81/03; B65D 75/04; B65D 77/0406; A45C 7/0081

(Continued)

(56) References Cited

U.S. PATENT DOCUMENTS 2,213,758 A 9/1940 Eichberg
3,030,640 A * 4/1962 Gosman ..... A47C 27/081 441/40

(Continued)

FOREIGN PATENT DOCUMENTS

EP 2631195 A1 8/2013
EP 2801537 A1 11/2014

(Continued)

OTHER PUBLICATIONS

Campbell, Phillip John, "The Rigidified Standing Pouch—A Concept for Flexible Packaging", A Thesis Written in Partial Fulfillment of the Requirements for the Degree of Master of Industrial Design, North Carolina State University School of Design Raleigh, 1993, pp. 1-35.

(Continued)

*Primary Examiner* — Rafael A Ortiz
(74) *Attorney, Agent, or Firm* — Amanda T Barry; David Michael Weirich

(57) ABSTRACT

A flexible package having first, second, and third flexible material layers, with the second flexible material layer being disposed between the first and third flexible material layers; a product receiving chamber having a product receiving chamber outer circumference defined by the first flexible material layer; a plurality of spaced first seals disposed around a package circumference, the first seals sealing the first, second and third flexible material layers together; a plurality of spaced second seals disposed around the product (Continued)

receiving chamber outer circumference, the second seals sealing the second and third flexible material layers together; a plurality of inner expansion chambers, each one of the plurality of chambers being defined between adjacent ones of the first seals; and a plurality of outer expansion chambers, each one of the plurality of chambers being defined between a second seal and an immediately adjacent first seal.

29 Claims, 17 Drawing Sheets

Related U.S. Application Data filed on Dec. 21, 2018, provisional application No. 62/810,987, filed on Feb. 27, 2019, provisional application No. 62/838,955, filed on Apr. 26, 2019, provisional application No. 62/851,224, filed on May 22, 2019, provisional application No. 62/851,230, filed on May 22, 2019, provisional application No. 62/864,555, filed on Jun. 21, 2019, provisional application No. 62/864,549, filed on Jun. 21, 2019.

(51) Int. Cl.

| | |
|---|---|
| ***B65B 55/20*** | (2006.01) |
| ***B65D 75/58*** | (2006.01) |
| ***B65D 75/04*** | (2006.01) |
| ***B65D 75/56*** | (2006.01) |
| ***B65B 43/08*** | (2006.01) |
| ***B65B 5/02*** | (2006.01) |
| ***B65B 31/04*** | (2006.01) |
| ***B65D 77/04*** | (2006.01) |
| *B65B 9/04* | (2006.01) |

(52) U.S. Cl.
CPC ..... *B65B 55/20* (2013.01); *B65D 75/04* (2013.01); *B65D 75/56* (2013.01); *B65D 75/58* (2013.01); *B65D 77/0406* (2013.01); *B65D 81/052* (2013.01); *B65B 2009/047* (2013.01); *B65D 2203/02* (2013.01)

(58) Field of Classification Search
USPC ..... 206/522, 521; 383/3
See application file for complete search history.

(56) References Cited

U.S. PATENT DOCUMENTS 3,346,101 A * 10/1967 Pestka ..... B65D 81/052 206/522
3,975,885 A 8/1976 Carlisle
4,190,158 A 2/1980 Ambrose
4,651,360 A * 3/1987 Wang ..... B63B 7/08 4/506
4,756,032 A * 7/1988 Wang ..... A63B 71/145 4/506
4,872,558 A 10/1989 Pharo
4,969,312 A 11/1990 Pivert
5,140,801 A 8/1992 Wild
5,170,609 A 12/1992 Bullock et al.
5,217,131 A 6/1993 Andrews
5,272,856 A 12/1993 Pharo
5,307,529 A * 5/1994 Wang ..... A61H 33/025 4/541.5
5,535,888 A 7/1996 De Luca
5,639,523 A 6/1997 Ellis
6,520,332 B1 2/2003 Barmore
6,520,333 B1 2/2003 Tschantz
6,520,491 B2 2/2003 Timlick
8,157,096 B2 4/2012 Liao
8,540,094 B2 9/2013 Riedl
9,327,867 B2 5/2016 Stanley et al.
9,469,088 B2 10/2016 Stanley
9,623,622 B2 4/2017 Baines
9,694,942 B2 7/2017 Stanley
9,815,258 B2 11/2017 Stanley
10,040,581 B2 8/2018 Stanley
2003/0034270 A1 2/2003 Ribeiro
2003/0167572 A1 9/2003 Mileti
2004/0101658 A1 5/2004 Kannankeril
2004/0149618 A1 8/2004 Otaki
2005/0109656 A1 5/2005 Ishizaki
2005/0126941 A1 6/2005 Ferri
2006/0030471 A1 2/2006 Schaller
2007/0092164 A1 4/2007 Yasuhira
2008/0029423 A1 2/2008 Davlin
2009/0242450 A1 10/2009 Zhang
2010/0072103 A1 3/2010 Watanabe
2010/0308062 A1 12/2010 Helou, Jr.
2011/0192121 A1 8/2011 Kannankeril et al.
2012/0097634 A1 4/2012 Riedl
2013/0292287 A1 11/2013 Stanley et al.
2013/0292353 A1 11/2013 Stanley et al.
2013/0292395 A1 11/2013 Stanley et al.
2013/0292413 A1 11/2013 Stanley et al.
2013/0292415 A1 11/2013 Stanley et al.
2013/0294711 A1 11/2013 Stanley et al.
2013/0313152 A1 11/2013 Liao
2013/0337244 A1 12/2013 Stanley et al.
2014/0033654 A1 2/2014 Stanley et al.
2014/0033655 A1 2/2014 Stanley et al.
2015/0033671 A1 2/2015 Stanley
2015/0034670 A1 2/2015 Stanley et al.
2015/0036950 A1 2/2015 Stanley et al.
2015/0121810 A1 5/2015 Bourgeois et al.
2015/0122373 A1 5/2015 Bourgeois et al.
2015/0122840 A1 5/2015 Cox et al.
2015/0122841 A1 5/2015 McGuire et al.
2015/0122842 A1 5/2015 Berg, Jr. et al.
2015/0122846 A1 5/2015 Stanley et al.
2015/0125099 A1 5/2015 Ishihara et al.
2015/0125574 A1 5/2015 Arent et al.
2015/0126349 A1 5/2015 Ishihara et al.
2015/0259120 A1 9/2015 Liao
2016/0058218 A1 3/2016 Yoshifusa
2016/0176578 A1 6/2016 Stanley et al.
2016/0176582 A1 6/2016 McGuire et al.
2016/0176583 A1 6/2016 Ishihara et al.
2016/0176584 A1 6/2016 Ishihara et al.
2016/0176597 A1 6/2016 Ishihara et al.
2016/0221727 A1 8/2016 Stanley et al.
2016/0297569 A1 10/2016 Berg, Jr. et al.
2016/0297589 A1 10/2016 You et al.
2016/0297590 A1 10/2016 You et al.
2016/0297591 A1 10/2016 You et al.
2016/0325518 A1 11/2016 Ishihara et al.
2016/0362228 A1 12/2016 McGuire et al.
2017/0001782 A1 1/2017 Arent et al.
2017/0233116 A1 8/2017 Stanley et al.
2017/0247164 A1 8/2017 Zhang
2017/0305609 A1 10/2017 McGuire et al.
2017/0305627 A1 10/2017 Arent et al.
2017/0314283 A1* 11/2017 Liu ..... A47C 4/54
2018/0079574 A1 3/2018 Ishihara et al.
2018/0236741 A1 8/2018 Hargett et al.
2018/0237172 A1 8/2018 Lester et al.
2018/0257836 A1 9/2018 McGuire et al.
2018/0297725 A1 10/2018 Bourgeois et al.
2018/0312283 A1 11/2018 Bourgeois et al.
2018/0312286 A1 11/2018 Lester et al.
2018/0370709 A1 12/2018 Kim
2020/0024050 A1 1/2020 Borrero
2020/0024051 A1 1/2020 Lester
2020/0024053 A1 1/2020 Borrero
2020/0024054 A1 1/2020 Borrero
2020/0024055 A1 1/2020 Borrero
2020/0024056 A1 1/2020 Borrero

(56) References Cited

U.S. PATENT DOCUMENTS

| | | | |
|---|---|---|---|
| 2020/0024057 | A1 | 1/2020 | Borrero |
| 2020/0024058 | A1 | 1/2020 | Clare |

FOREIGN PATENT DOCUMENTS

| | | | |
|---|---|---|---|
| FR | 2680764 | B1 | 3/1994 |
| GB | 1403912 | A | 8/1975 |
| GB | 2213464 | A | 8/1989 |
| WO | 9601775 | A1 | 1/1996 |
| WO | WO9737905 | A1 | 10/1997 |
| WO | 2004103851 | A1 | 12/2004 |
| WO | WO2012073004 | | 6/2012 |

OTHER PUBLICATIONS

All Office Actions, U.S. Appl. No. 16/515,507.
All Office Actions, U.S. Appl. No. 16/515,537.
All Office Actions, U.S. Appl. No. 16/516,175.
International Search Report and Written Opinion; Application No. US2019/042361 dated Oct. 21, 2019; 11 pages.

* cited by examiner

FLEXIBLE PACKAGE

FIELD OF THE DISCLOSURE

The present disclosure relates in general to flexible packages, and more particularly to flexible packages having air-filled chambers.

BACKGROUND

E-commerce, or the use of the internet to find and purchase goods, is becoming a very popular way for consumers to shop. The advantages of e-commerce are many including: time-savings; competition; shopping at home, work or virtually anywhere; and importantly, the purchaser not having to transport the purchased articles from the location of purchase to the place of use. In the e-commerce system, goods purchased by consumers are generally transported to their homes or places of use by the seller or a service used by the seller. Many e-commerce retailers rely on shipping their goods through the mail, including government mail services and other private and semi-private mail services, or through other parcel or parcel-like delivery services. Such mail and parcel services are typically quite convenient to both the buyer and seller. However, transportation of fragile, heavy and/or bulky goods can be quite expensive due to the cost of the manual labor and materials needed to protect the goods during shipment.

These aspects, and others, relating to the shipment of goods through current mail and parcel delivery services create unique issues that, if not addressed, can negatively affect the cost and quality of the goods sold. For example, when shipping goods to consumers, the goods generally need to be disposed in a package that is strong, lightweight and convenient for the shipper and for the customer. That is, it should be designed to be capable of protecting the products being shipped from external conditions throughout the shipping process, and preferably so as to minimize material usage, weight and bulkiness. It should also be easy to construct, pack, close, label, open, and discard. If the shipping package does not meet any one or all of these characteristics, it can lead to extra costs, inconvenience for the seller or buyer, product damage, and/or consumer dissatisfaction.

Currently, most shipping packages are some form of flexible pouch (e.g. envelope) made from paper or plastic, or a box, often constructed from corrugated paperboard or cardboard. Although these shipping packages can be used to ship many different types of goods and are reasonably inexpensive, they generally are generic in the sense that they do not provide a custom fit for the products being shipped. This can lead to additional packaging being required to prevent damage to the products being shipped, significant volume being taken up in shipping trucks and warehouses due to the ill-fitting packaging, and difficulty for the consumer to open and/or discard of the shipping packaging. To address the ill-fitting, generic packaging, sellers often stuff the outer shipping packages with some type of material intended to fill the open area not filled by the goods themselves. Alternatively, sellers may employ additional processes to manipulate the products, and/or add protective layers to the product or primary packaging to ensure the product can be safe when placed into generic containers. However, both of these scenarios add more steps to process, weight, waste, and cost to the packaging and packing process, and often makes the consumer's experience when opening the package less than desirable (e.g. "packing peanuts" falling out of the package or tool is required to open package). Further, many of the current shipping packages are not weather or environment-resistant and can be damaged by or allow damage to the products being shipped by precipitation, wet surfaces and/or humidity. Accordingly, often such packages are wrapped in additional materials or must be placed in protected locations if they are to be left outside or unattended for any period of time.

In addition, packages made of flexible materials such as films and webs often cause problems during shipping and/or handling because they are difficult to transport on conveyor equipment and/or are difficult to stack. Such deficiencies can lead to product and equipment breakage as well as increased costs and time needed for shipping and handling. Further, such flexible packages are typically not shaped in a way to advantageously protect the products therein and/or to provide improved shipping and handling.

SUMMARY

Packages in accordance with the disclosure can have one or more benefits including being low cost, yet customizable in terms of fit to the products being shipped, requires no additional fill to protect the goods, easy to pack, easy to open, easy to close, lightweight yet provides protection to the goods being shipped. It also would be desirable to provide a shipping package that is easy to close, takes up very little volume before and after use and is efficient in terms of volume when configured for shipping, easy to discard, recyclable, easily conveyed on conveyor equipment, and easily stacked. Conveyability can be provided by packages made of flexible materials that are shaped by expanding certain chambers therein. Packages can further include gussets to aid in shaping and to enable products of different sizes to better fit within the package.

A flexible package can include a product receiving chamber; a first set of expansion chambers surrounding the product receiving chambers, the first set of expansion chambers comprising a plurality of inner expansion chambers adapted to receive an expansion material and at least expand inwardly and towards the product receiving chambers; and a second set of expansion chambers disposed outward of and at least partially surrounding the first set of expansion chambers, the second set of expansion chambers comprising a plurality of outer expansion chambers adapted to receive an expansion material and expand outwardly and away from the first set of expansion chambers. At least one of the plurality of inner expansion chambers can have a wall in common with at least one of the plurality of outer expansion chambers, the wall having opposed first and second surfaces, with the first surface of the wall facing an interior volume of the inner expansion chamber and the second surface of the wall facing an interior volume of the at least one outer expansion chamber. In some packages disclosed herein, each one of the plurality of inner expansion chambers can have a wall in common with at least one of the plurality of outer expansion chambers.

The expanded flexible package can include a product receiving chamber; a first set of expansion chambers surrounding the product receiving chamber(s), the first set of expansion chambers comprising a plurality of inner expansion chambers, wherein one or more of the plurality of inner expansion chambers is filled with an expansion material and expanded such that a portion of the inner expansion chambers extends inwardly and towards the product receiving chambers; and a second set of expansion chambers surrounding the first set of expansion chambers, the second set of expansion chambers comprising a plurality of outer expansion chambers, wherein one or more of the plurality of outer expansion chambers is filled with an expansion material and expanded such that a portion of the outer expansion chambers extends outwardly and away from the first set of expansion chambers. At least one of the plurality of inner expansion chambers can have a wall in common with at least one of the plurality of outer expansion chambers, the wall having opposed first and second surfaces, with the first surface of the wall is facing an interior volume of the inner expansion chamber and the second surface of the wall facing an interior volume of the outer expansion chamber. In embodiments, each one of the plurality of inner expansion chambers can have a wall in common with at least one of the plurality of outer expansion chambers.

The flexible package can include a plurality of panels that cooperate to define a product receiving chamber having an outer perimeter defined by a first flexible material layer; a second flexible material layer spaced from and surrounding the first flexible material layer; and a third flexible material layer space from and surrounding the second flexible material layer, the first, second, and third flexible material layers being sealed together in a plurality of discrete locations to define first seals, with a plurality of inner expansion chambers bounded by adjacent ones of the first seals and having an inner expansion chamber volume constrained between the first and second flexible material layers, and the third flexible material layer and the second flexible material layer being sealed together in a plurality of discrete locations to define second seals, with a plurality of outer expansion chambers bounded by adjacent first and second seals and/or adjacent second seals, and having an outer expansion chamber volume constrained between the second and third flexible material layers. The plurality of inner and outer expansion chambers may be adapted to receive an expansion material and expand. When the inner and outer expansion chambers are filled with an expansion material and/or when air is removed from the product receiving chamber, the one or more inner expansion chambers at least expands inwardly towards the product receiving chambers, pulling third flexible material layer inwardly towards the product receiving chamber.

The flexible package can include first, second, and third flexible material layers, with the second flexible material layer being disposed between the first and third flexible material layers; a product receiving chamber having a product receiving chamber outer circumference defined by the first flexible material layer; a plurality of spaced first seals disposed around a package circumference, the first seals sealing the first, second and third flexible material layers together; a plurality of spaced second seals disposed around the product receiving chamber outer circumference, the second seals sealing the second and third flexible material layers together; a plurality of inner expansion chambers, each one of the plurality of chambers being defined between adjacent ones of the first seals; and a plurality of outer expansion chambers, each one of the plurality of chambers being defined between a second seal and an immediately adjacent first seal. In at least a portion of the package, at least two second seals may be disposed between adjacent ones of the first seals such that at least two outer expansion chambers are defined within one inner expansion chamber, and the plurality of inner and outer expansion chambers are adapted to receive an expansion material and expand. When one or more of the plurality of inner expansion chambers is filled with an expansion material, the one or more inner expansion chambers expands inwardly towards the product receiving chambers, and when one or more of the plurality of outer expansion chambers is filled with an expansion material, the one or more outer expansion chambers expands outwardly away from the one or more inner expansion chambers.

The flexible package can include a product receiving chamber surrounded by or partially surrounded by a plurality of expansion chambers. The product receiving chamber can have air removed therefrom once product is included within the product receiving chamber to conform a flexible material layer defining an outer perimeter of the product receiving chamber to the product, thereby immobilizing the product. The flexible package can further include expansion of the plurality of expansion chambers to provide a protective cushion around the product receiving chamber. The flexible material can have two sheets or more, or three sheets or more.

BRIEF DESCRIPTION OF THE DRAWINGS

While the specification concludes with claims particularly pointing out and distinctly claiming the subject matter that is regarded as the present invention, it is believed that the invention will be more fully understood from the following description taken in conjunction with the accompanying drawings. Some of the figures may have been simplified by the omission of selected elements for the purpose of more clearly showing other elements. Such omissions of elements in some figures are not necessarily indicative of the presence or absence of particular elements in any of the exemplary embodiments, except as may be explicitly delineated in the corresponding written description. None of the drawings are necessarily to scale.

DETAILED DESCRIPTION

Figure 1A:
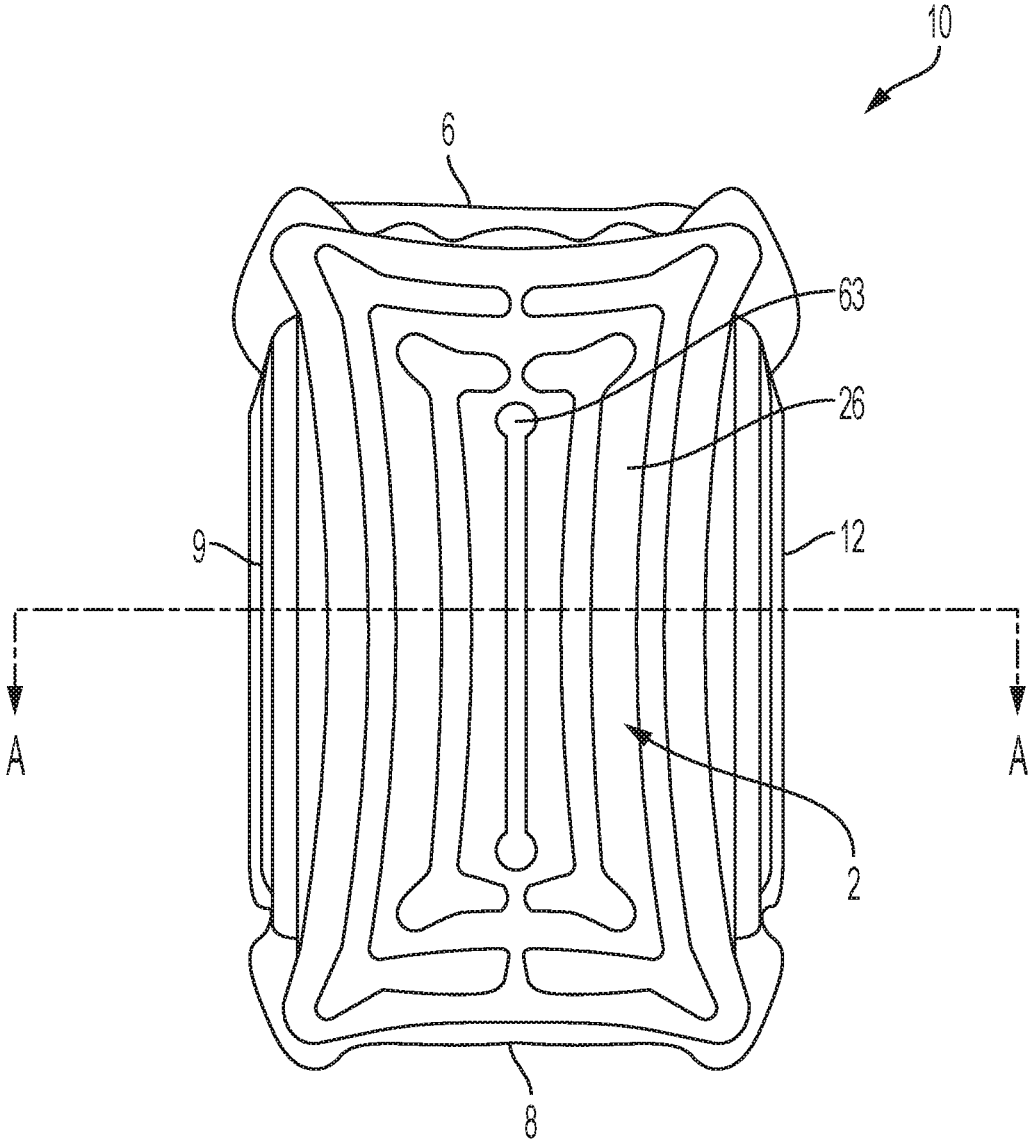
FIG. 1A is front panel view of a package in accordance with embodiments of the disclosure.

Disclosed herein are flexible packages for containing a product. The flexible packages may be made from flexible material(s), which can reduce weight, reduce waste, and reduce material costs, particularly as compared to conventional rigid shipping packages. For a variety of uses, including shipping packages, the packages need to be conveyable—that is able to securely reside on a conveyor and other generally planar surfaces such as table tops, shelves, and in shipping containers. Further, such packages are often beneficial where they can be efficiently stacked, reducing the volume taken up on a shelf or in a truck or other cargo space.

It has been advantageously found that the packages in accordance with the disclosure can provide good conveyability. The packages 10 can have a substantially cuboid shape, which can enhance packing efficiency of the packages 10. It has been advantageously found that the surface characteristics of a panel of the packages, including a degree of flatness or the amount of contact a panel has with an underlying substantially planar surface can be tailored by controlling the relative sizing, arrangement, and/or orientation of expansion chambers disposed in the respective panel of the package. It has been beneficially found that multiple points and even lines of contact of one or more panels of the packages can be provided in various embodiments. Further, by providing more planar panel surfaces, an improved cuboid shape can be imparted, thereby allowing for improved packing efficiency and stackability. Yet another desirable feature of the packages of the present disclosure is that they can be easily shaped and configured for machine handling and use with autonomous vehicles and drones. The packages provide protection from bumping and dropping and have expandable chambers that can be used to provide grip regions for humans and machines.

The flexible packages disclosed herein can be configured to have an overall shape. In the unexpanded state, the overall shape may correspond to any known two-dimensional shape including polygons (shapes generally comprised of straight-portions connected by angles), curved-shapes (including circles, ovals, and irregular curved-shapes) and combinations thereof. In the expanded state, the overall shape may correspond with any other known three-dimensional shape, including any kind of polyhedron, any kind of prismatoid, any kind of prism (including right prisms and uniform prisms), and any kind of parallelepiped. Regardless of the overall shape, the package can include at least one primary conveying panel which has at least 2, 3, 4, 5, 6, 7, 8, 9, or 10 points of contact, or two or more lines of contact, or a plane of contact with a substantially planar surface upon which the package rests. The package can have at least one primary conveying panel that is flat or substantially flat. The package can have at least one primary conveying panel having lines of contact with an underlying surface that are configured in the shape of one or more frames at or near the perimeter of the panel.

As used herein, the term "closed" refers to a state of a package, wherein any products within the package are prevented from escaping the package (e.g. by one or more materials that form a barrier), but the package is not necessarily hermetically sealed. For example, a closed package can include a vent, which allows a head space in the package to be in fluid communication with air in the environment outside of the package.

As used herein, when referring to a flexible package, the terms "disposable" and "single use" refer to packages which, after being used for its intended purpose (e.g. shipping a product to an end user), are not configured to be reused for the same purpose, but is configured to be disposed of (i.e. as waste, compost, and/or recyclable material). Part, parts, or all of any of the flexible packages, disclosed herein, can be configured to be disposable and/or recyclable.

As used herein, when referring to a flexible package, the term "durable" refers to a package that is intended to be used more than one time. Part, parts, or all of any of the flexible packages, disclosed herein, can be configured to be durable and/or recyclable.

As used herein, when referring to a flexible package, the term "expanded" or "inflated" refers to the state of one or more flexible materials that are configured to change shape when an expansion material is disposed therebetween. An expanded structure has one or more dimensions (e.g. length, width, height, thickness) that is significantly greater than the combined thickness of its one or more flexible materials, before the structure has one or more expansion materials disposed therein. Examples of expansion materials include liquids (e.g. water), gases (e.g. compressed air), fluent products, foams (that can expand after being added into a structural support volume), co-reactive materials (that produce gas or foam), or phase change materials (that can be added in solid or liquid form, but which turn into a gas; for example, liquid nitrogen or dry ice), or other suitable materials known in the art, or combinations of any of these (e.g. fluent product and liquid nitrogen). Expansion materials can be added at atmospheric pressure, or added under pressure greater than atmospheric pressure, or added to provide a material change that will increase pressure to something above atmospheric pressure. For any of the flexible packages disclosed herein, its one or more flexible materials can be expanded at various points in time with respect to its manufacture, sale, and use. For example, one or more portions of the package may be expanded before or after the product to be shipped in the package is inserted into the package, and/or before or after the flexible package is purchased by an end user.

As used herein, the term "flexible shipping package" refers to a flexible package configured to have an article reservoir for containing one or more articles for shipment. Examples of flexible packages can be made from film, woven web, non-woven web, paper, foil or combinations of these and other flexible materials.

As used herein, when referring to a flexible package, the term "flexible material" refers to a thin, easily deformable, sheet-like material, having a flexibility factor within the range of 1,000-2,500,000 N/m. Flexible materials can be configured to have a flexibility factor of 1,000-2,500,000 N/m, or any integer value for flexibility factor from 1,000-2,500,000 N/m, or within any range formed by any of these values, such as 1,000-1,500,000 N/m, 1,500-1,000,000 N/m, 2,500-800,000 N/m, 5,000-700,000 N/m, 10,000-600,000 N/m, 15,000-500,000 N/m, 20,000-400,000 N/m, 25,000-300,000 N/m, 30,000-200,000 N/m, 35,000-100,000 N/m, 40,000-90,000 N/m, or 45,000-85,000 N/m, etc. Throughout the present disclosure the terms "flexible material", "flexible sheet", "sheet", and "sheet-like material" are used interchangeably and are intended to have the same meaning.

Examples of materials that can be flexible materials include one or more of any of the following: films (such as plastic films), elastomers, foamed sheets, foils, fabrics (including wovens and nonwovens), biosourced materials, and papers, in any configuration, as separate material(s), or as layer(s) of a laminate, or as part(s) of a composite material, in a microlayered or nanolayered structure, and in any combination, as described herein or as known in the art. For example, a flexible material may be a laminate of a paper to a PVOH material. Part, parts, or all of a flexible material can be coated or uncoated, treated or untreated, processed or unprocessed, in any manner known in the art. Parts, parts, or about all, or approximately all, or substantially all, or nearly all, or all of a flexible material can made of sustainable, bio-sourced, recycled, recyclable, and/or biodegradable material. Part, parts, or about all, or approximately all, or substantially all, or nearly all, or all of any of the flexible materials described herein can be partially or completely translucent, partially or completely transparent, or partially or completely opaque. The flexible materials used to make the packages disclosed herein can be formed in any manner known in the art, and can be joined together using any kind of joining or sealing method known in the art, including, for example, heat sealing (e.g. conductive sealing, impulse sealing, ultrasonic sealing, etc.), welding, crimping, bonding, adhering, and the like, and combinations of any of these. Flexible materials for making packages disclosed herein can have one or more sheets. For example, flexible materials can have three sheets.

As used herein, the term "joined" refers to a configuration wherein elements are either directly connected or indirectly connected.

As used herein, when referring to a sheet or sheets of flexible material, the term "thickness" refers to a linear dimension measured perpendicular to the outer major surfaces of the sheet, when the sheet is lying flat. The thickness of a package is measured perpendicular to a surface on which the package is placed such that the sheet would be lying flat if the package were not in an expanded state. To compare the thickness of a package in an unexpanded state, an expanded state and a deflated state, the thickness of each should be measured in the same orientation on the same surface. For any of the configurations, the thickness is considered to be the greatest thickness measurement made across the surface or face of the article in that particular orientation.

As used herein, the term "product receiving chamber" or "product receiving reservoir" refers to an enclosable three-dimensional space that is configured to receive and contain one or more articles or products. This three-dimensional space may enclose a volume, the "product receiving volume". The articles or products may be directly contained by the materials that form the product receiving chamber. By directly containing the one or more products, the products come into contact with the materials that form the enclosable three-dimensional space, there is no need for an intermediate material or package. The shipping packages described herein can be configured to have any number of product receiving chambers 28 including any number of divisions or internal walls, whether full or partial, dividing the inner volume of the package into any number of product receiving chambers. Further, one or more of the reservoirs may be enclosed within another reservoir. Any of the product receiving chambers 28 disclosed herein can have a product receiving volume of any size. The product receiving chamber(s) 28 can have any shape in any orientation.

As used herein, when referring to a flexible package, the term "expansion chamber" refers to a fillable space made from one or more flexible materials, wherein the space is configured to be at least partially filled with one or more expansion materials, which create tension in the one or more flexible materials, and form an expanded volume.

As used herein, when referring to a flexible package, the term "unexpanded" refers to the state of an expansion chamber, when the chamber does not include an expansion material.

Generally, a flexible package 10 can include a plurality of panels that cooperate to define an interior volume into which a product can be received. The flexible package 10 can be defined by one or more layers and/or distinct sheets of flexible material. While reference is made herein to "flexible material layers," it should be understand that such layers can be the result of folding of a sheet of flexible material onto itself and/or the presence of distinct sheets of flexible material. Any suitable combination of folding of sheet(s) and/or sealing of distinct sheets can be used.

Figure 1B:
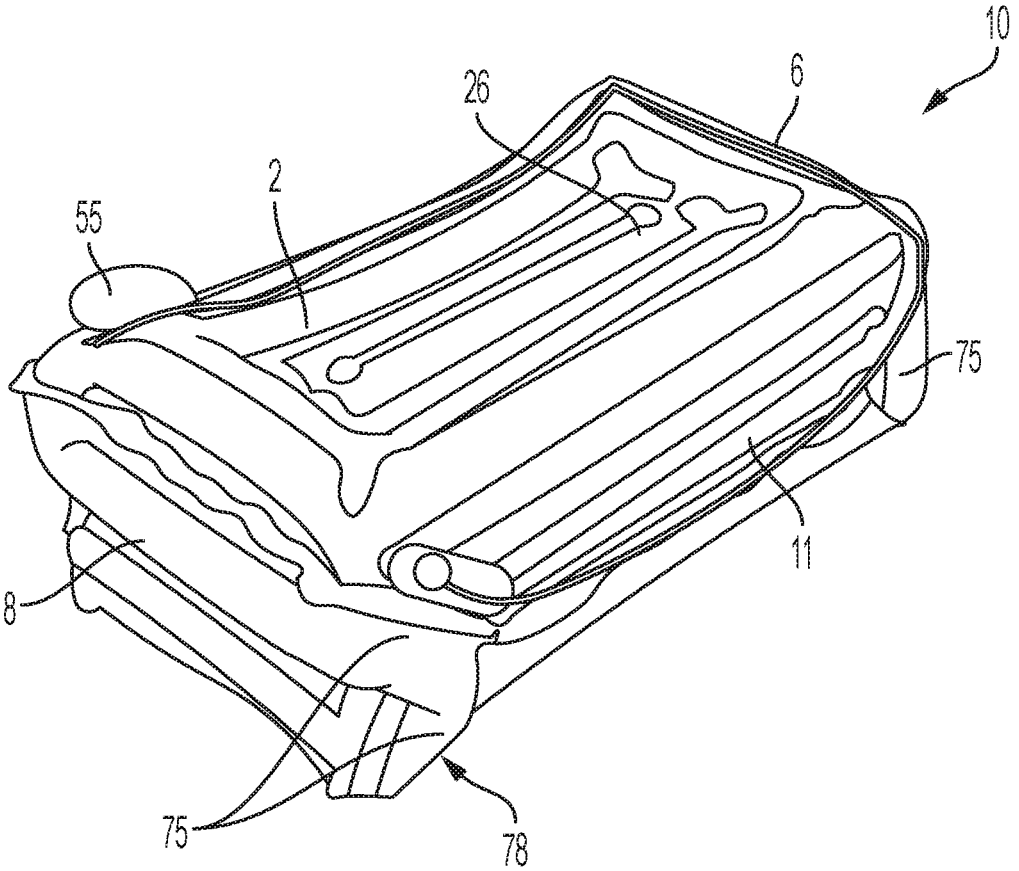
FIG. 1B is a perspective view of a package in accordance with embodiments of the disclosure.

Referring to FIGS. 1 and 2, flexible packages 10 in accordance with the disclosure can be of various shapes, for example, a generally cuboid shape. Packages may have rounded edges and/or corners and for purposes herein are considered generally cuboid. In the embodiments illustrated in FIGS. 1A and 1B, the cuboid is formed from six generally rectangular panels that cooperate to define an internal volume which functions as a product receiving chamber 28. However, other suitable quadrilaterals can be used, such as squares, and combinations of square and rectangular panels. It should be understood herein that the panels are generally quadrilateral in shape and may have rounded corners or other rounded edges or surfaces.

As illustrated in FIGS. 1A and 1B, the flexible package 10 can include one or more panels upon which the package 10 is designed to stand. The flexible package 10 can include one or more primary conveying panels, upon which the flexible package 10 is designed to reside during conveying. In the embodiments illustrated in FIGS. 1 and 2, for example, the front and back panels 2, 4 are designed as the primary conveying panels such that the package 10 is configured to be conveyed in the orientation illustrated in FIG. 1B. As illustrated in FIG. 1A, the package 10 can include one or more additional panels upon which the package 10 can stand. In FIG. 1A, the package 10 is standing on a bottom panel 8 and could similarly be configured to stand on the top panel 6. The package 10 can further include opposed side panels 9, 11. The side panels 9, 11 can include one or more gussets 75.

Reference is made herein to the front and back panels 2, 4 as the primary conveying panels. However, other package orientations are contemplated herein, and the discussion regarding conveyability of the front and back panels can be applied to other panels, should configurations in which other panels are desired to be alternative or additional primary conveying panels As discussed in detail below, first and second sets of expansion chambers 3, 5 can have a one or more of inner and outer expansion chambers 24, 26 on the front and back panels 2, 4 that can be arranged to tailor the shape and overall flatness of the panels, which can correlate to conveyability. For example, a package can include one inner expansion chamber 24 and one outer expansion chamber 26. For example, a package can include a plurality of expansion chambers 24 and a plurality of outer expansion chambers 26. Any one or more of the plurality of expansion chambers, whether inner or outer, can be fluidly coupled such that they can be inflated together from an expansion material input port. One or more of the plurality of expansion chambers could be discrete and designed to be inflated through a dedicated expansion port. Any combination of fluidly coupled and discrete expansion chambers can be included.

In particular, it has been found that control over the relative sizing, orientation, arrangement, number and/or expansion pressures in the plurality of inner and outer expansion chambers 24, 26 of the first and second sets of expansion chambers 3, 5 can be used to tailor the number of points of contact a panel has with an underlying surface upon which it rests. Multiple points, lines, and planes of contacts can be provided. A panel can have two or more points of contact with an underlying surface, for example, at or near corners of the panel. A panel can have four or more points of contact with an underlying surface, for example, with four points lying at or near the corners of the panel. A plurality of lines of contact, such as a frame-like arrangement of lines of contact at or near a perimeter of the panel can be provided. A central portion of the panel can be substantially coplanar with the points, or can be concave, laying below the points of contact.

Figure 3A:
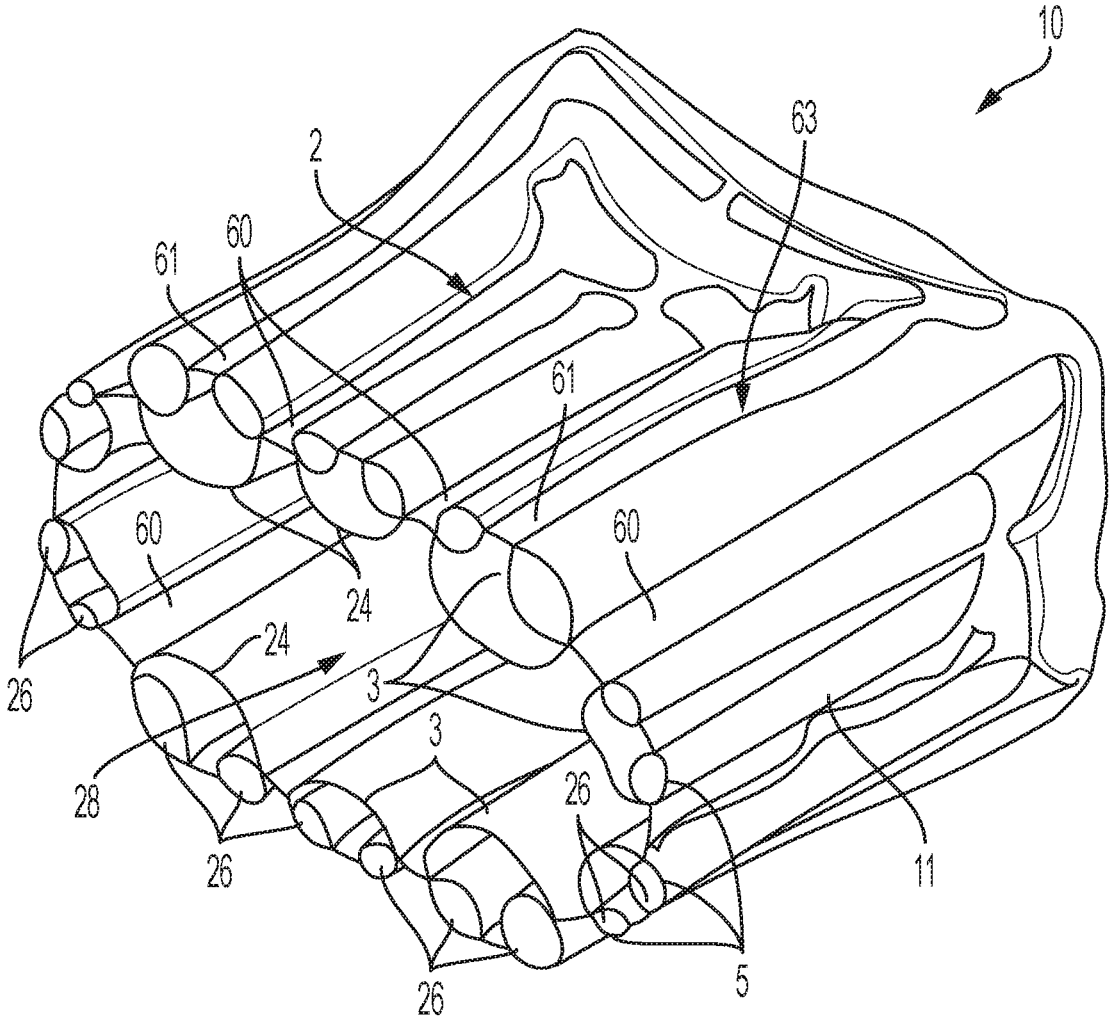
FIG. 3A is a cross-sectional view of the package of FIG. 1 through line 3A-3A.

Referring to FIG. 3A, package 10 includes a first set of expansion chambers 3 that surrounds partially or entirely the product receiving chamber 28, and a second set of expansion chambers 5 that surrounds partially or entirely the first set of expansion chambers 3. The first and second sets of expansion chambers 3, 5 can have a plurality of inner and outer expansion chambers 24, 26 that are disposed on the front and/or back panels. In various packages of the disclosure, the first and second sets of expansion chambers 3, 5 can have a plurality of inner and outer expansion chambers 24, 26 that are disposed on the front and/or back panels, as well as one or both of the side panels, and optionally one or both of the top and bottom panels.

Figure 5A:
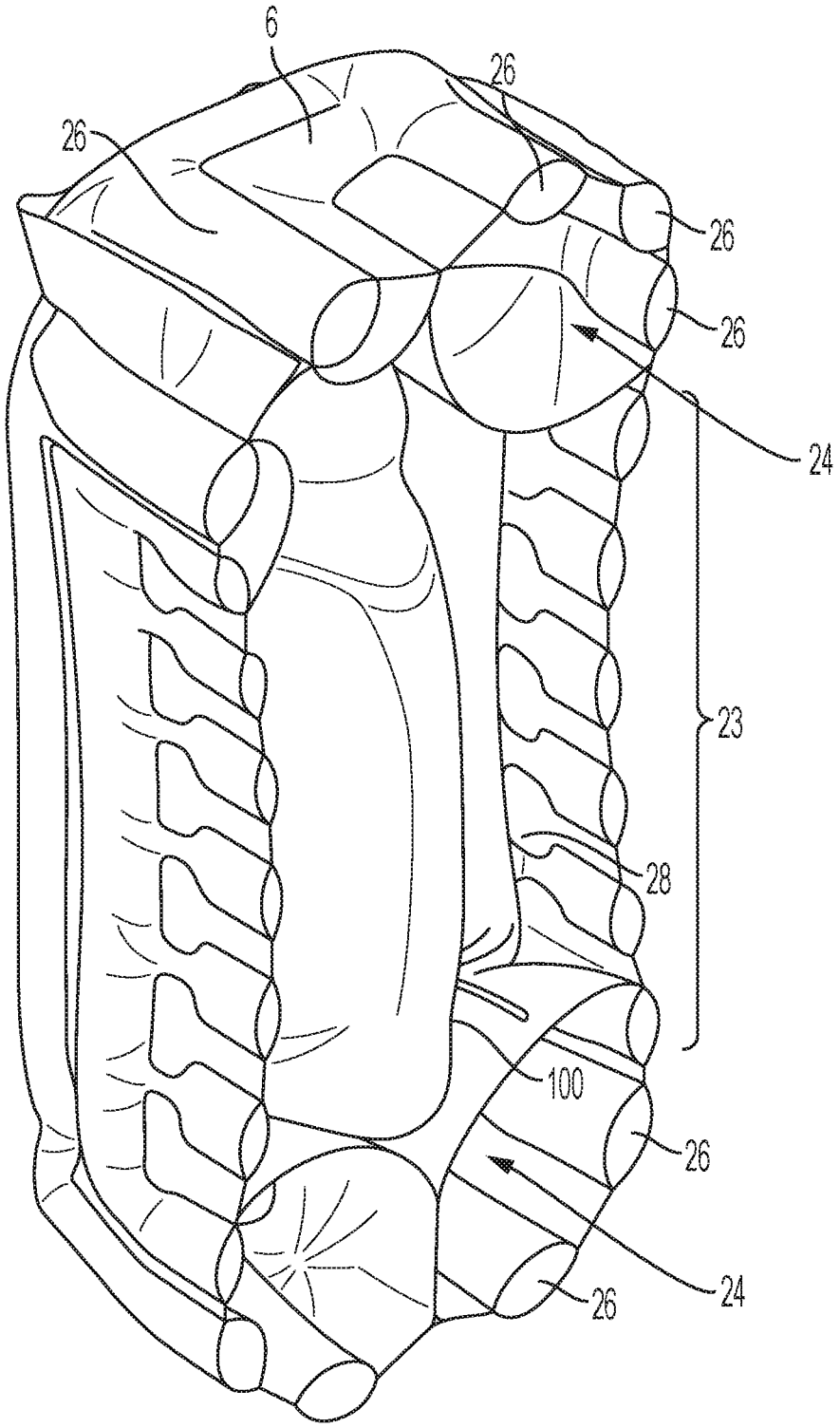
FIG. 5A is a cross-sectional view of the package of FIG. 4A taken through line 5A-5A in FIG. 4A.
Figure 5B:
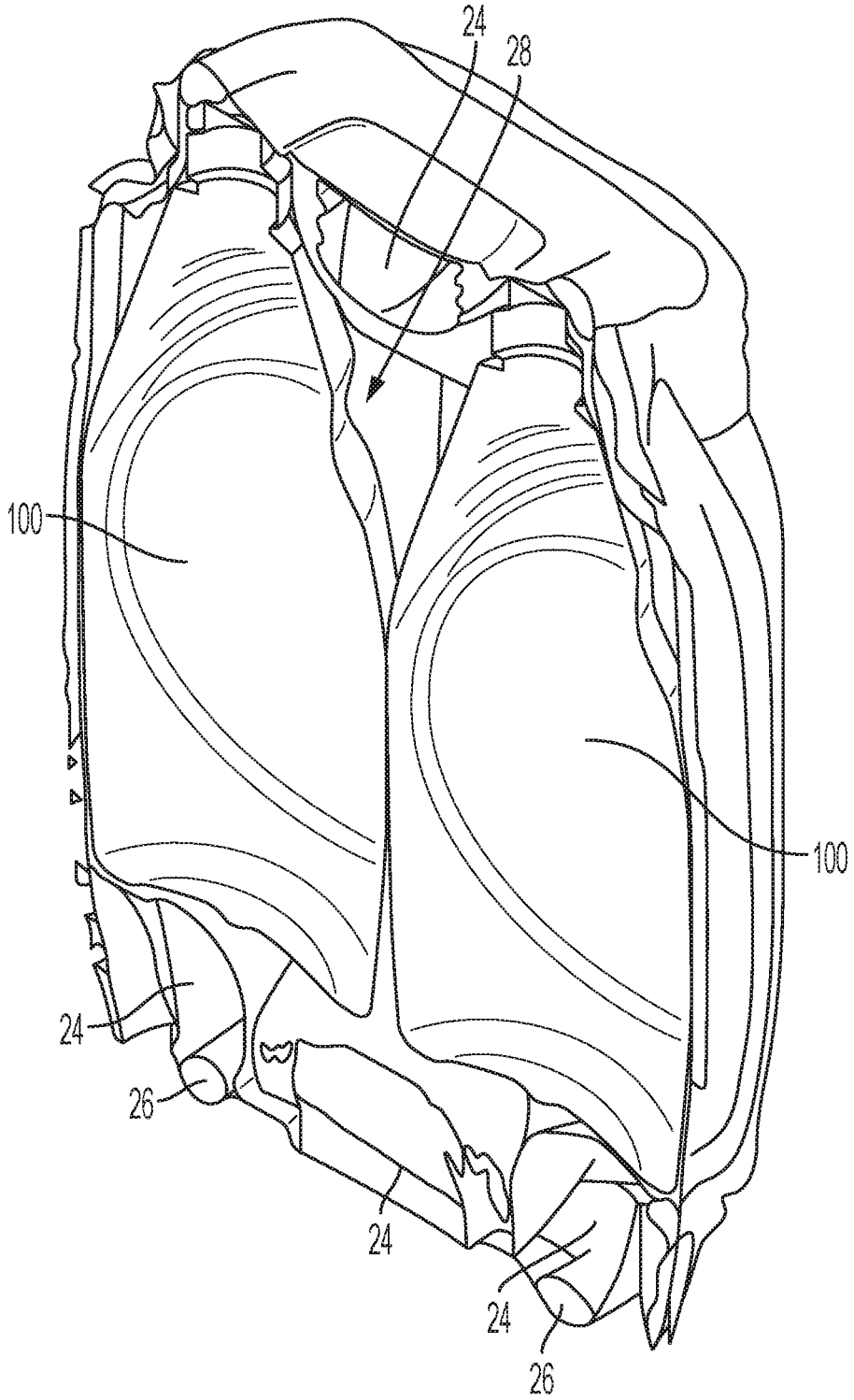
FIG. 5B is a cross-sectional view of the package of FIG. 4A, taken through line 5B-5B in FIG. 4B.

The package 10 can include additional sets of expansion chambers distinct from and/or cooperating with, for example fluidly coupled with, one or both of the first and second sets of expansion chambers 3, 5. For example, as illustrated in FIG. 5B, a top and bottom panels of the package 10 can include one or more sets of expansion chambers configured to provide an exterior surface that has points of contact with an underlying surface to allow the package 10 to stand. Additionally or alternatively, such sets of expansion chambers can include a combination of inner and outer expansion chambers 24, 26 that cooperate to provide improved retention of the product with in the product receiving chamber 28 and/or protect potentially sensitive regions of the product, such as tips, corners, and edges. For example, in FIG. 5B, a package 10 is illustrated having sets of expansions chambers on the top and bottom panels that provide an inner expansion chamber 24 the extends to be disposed between and/or abut the adjacent product bottles 7, which can aid in preventing shifting and contact of the product bottles during transport. Further, outer expansion chambers 26 are illustrated in FIG. 5B, which provide a frame like structure that can help the package 10 stand on the top or bottom panels.

The first and second expansion chambers 3, 5 can cooperate to improve the planar nature of at least the primary conveying surface. The first set of expansion chambers 3 have a plurality of inner expansion chambers 24 that are configured to expand upon receiving an expansion material 25 such that they extend inwardly towards the product receiving chamber 28. The second set of expansion chambers 5 includes a plurality of outer expansion chambers 26 that are configured to expand upon receiving an expansion material 29 such that they extend outwardly away from the product receiving chamber 28. As illustrated in FIG. 1, when expanded these outer expansion chambers 26 can provide visually observable rib like structures on the outer surface of the package. Various arrangements and configurations of the first and second sets of expansion chambers, 3, 5 can be utilized, as detailed below. In the embodiment of FIG. 1, for example, the front and back panels are provided with concentric frame-like structures defined by the first and second expansion chambers 3, 5.

Referring to FIG. 3A, the interior volume of the package 10 serves as a product receiving chamber 28. The product receiving chamber 28 can be a single chamber or can be multiple chambers. The product receiving chamber 28 can be divided into multiple chambers by a layer of flexible material, a distinct sheet of flexible material, or any other suitable insert or structure. The product receiving chamber 28 can be sized depending on the products or articles 100 to be contained as well as the number of products to be contained. The terms product and articles are used interchangeably herein to reference anything that is to be contained in the packages 10 of the disclosure.

Figure 3B:
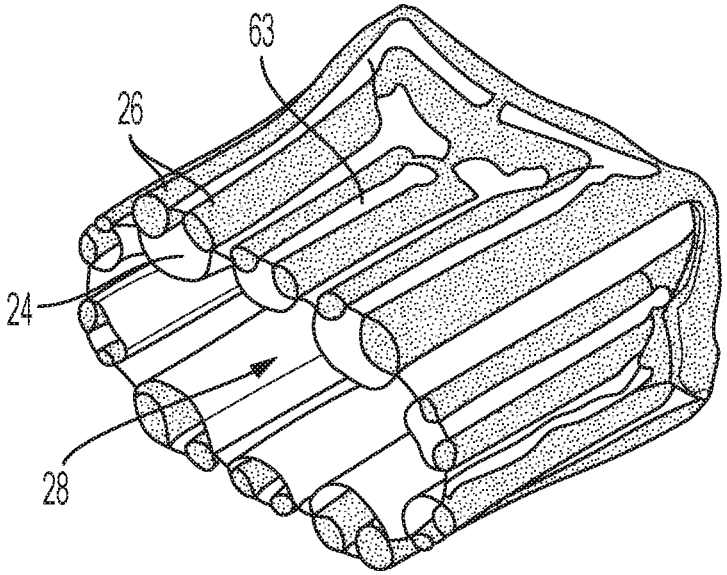
FIG. 3B is the cross-sectional view of the package in FIG. 3A, showing the second set of expansion chambers in dark grey fill.
Figure 3C:
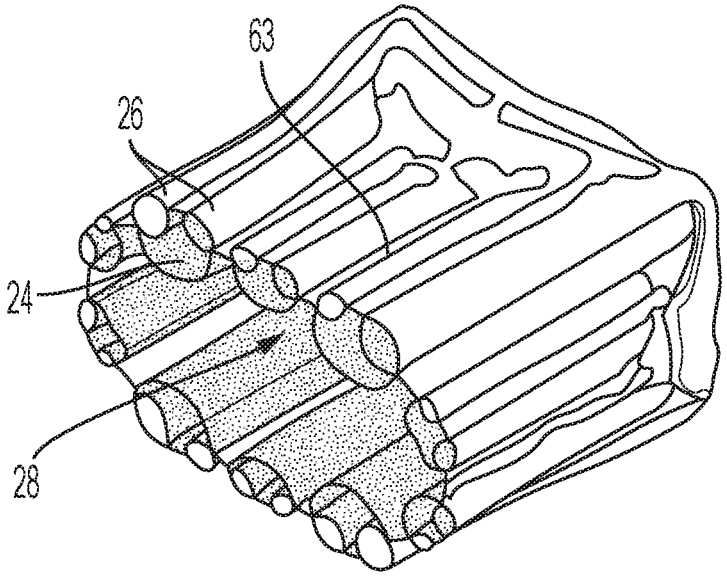
FIG. 3C is the cross-sectional view of the package of FIG. 3A, showing the first set of expansion chambers in dark grey fill.
Figure 3D:
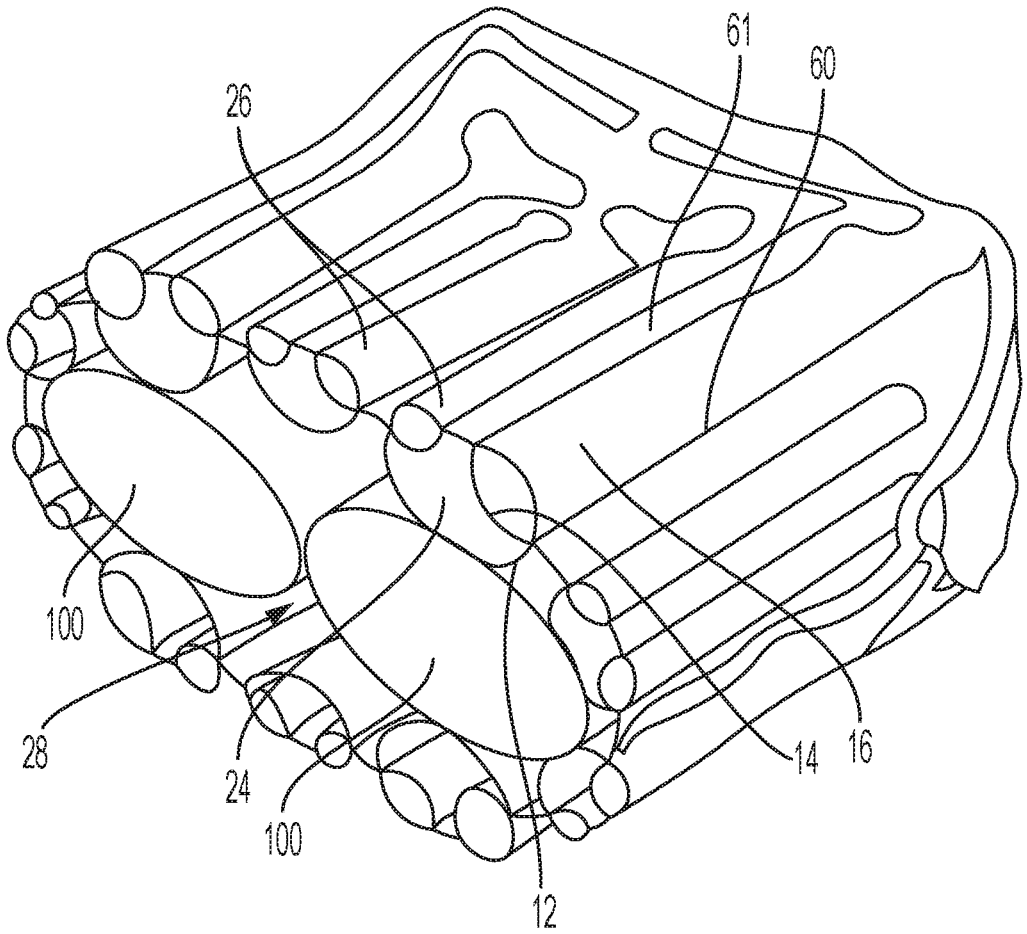
FIG. 3D is the cross-sectional view of the package of FIG. 3A, showing the two bottle-shaped articles residing the product receiving chamber.

Referring to FIG. 3D, the product receiving chamber 28 can be sized to receive multiple products 100 within a single chamber. In the embodiment illustrated in FIG. 3D, for example, the product receiving chamber 28 is illustrated housing two bottle shaped products 7. Advantageously, it has been found that when housing multiple products within a single product receiving chamber 28, the packages 10 of the disclosure can provide isolation and/or securely retain the multiple products such that they do not repeatedly contact each other during shipping or other movement of the package, which can lead to breakage and/or leakage of the products. The first set of inner chambers, which expands into or towards the product receiving chamber 28 can conformed around the product(s) 100 housed within the product receiving chamber 28 to securely retain the product(s) 100 and in various embodiments isolate the products 100 such that they do not shift and contact each other while housed in the package. The sizing and arrangement of the inner expansion chambers 24 can be tailored to the product to be retained in the package. For example, as illustrated in FIG. 5A, the bottom panel 8 can include two larger inner expansion chambers 24 that expanded inwardly towards the product receiving chamber to secure the bottom region of the products (shown as bottles). This can be advantageous in certain products such as bottles, as the bottom portion of the product 100 may be more rigid, and/or pressure applied by the inner expansion chambers 24 in other regions of the product 100, such as at a cap, could cause leakage.

FIG. 3A is a cross-sectional image of a package 10 in accordance with embodiments of the disclosure showing an arrangement of inner expansion chambers 24 and outer expansion chambers 26. FIG. 3B is the same cross-section illustrated in FIG. 3A, but highlights in gray fill the volume $V_{outer2}$ of the outer expansion chambers 26 when in an expanded state. FIG. 3C similarly is the same cross-section illustrated in FIG. 3A, but highlights in gray fill the volume $V_{inner2}$ of the inner expansion chambers 24 in an expanded state.

Referring to FIGS. 3A and 3C, in embodiments, the first set of expansion chambers 3 can be defined between first and second flexible material layers 12, 14. The first flexible material layer 12 can also define an outer perimeter of the product receiving chamber 28 in various embodiments. Referring to FIG. 3B, the second set of expansion chambers 5 can be defined between the second flexible material layer 14 and a third flexible material layer 16. Thus, in embodiments, as show in FIGS. 3A to 3C, the first set of expansion chambers 3 and the first set of expansion chambers 5 have the second flexible material layer 14 as part of both the inner and the outer expansion chambers 24, 26. That is, the second flexible material layer 14 has opposed first and second surfaces, with the first surface facing the interior volume of the inner expansion chambers 24 and the second surface facing the interior volume of the outer expansion chambers 26.

The first, second, and third flexible materials 12, 14, 16 are sealed together in discrete locations to form a plurality of first seals 60; and the second and third flexible materials 14, 16 are sealed together at discrete locations to form a plurality of second seals 61. One or more second seals 61 are disposed between adjacent first seals 60. Any of the seals disclosed herein can be formed using methods well-known in the art, including, heat sealing (e.g. conductive sealing, impulse sealing, ultrasonic sealing, etc.), welding, crimping, bonding, adhering, and the like, and combinations of any of these.

Inner expansion chambers 24 are formed between adjacent ones of the first seals 60, bounded by the portions of the first and second flexible material layers 12, 14 disposed between the adjacent ones of the first seals 60. Outer expansion chambers 26 can be formed between adjacent first and second seals 60, 61, and/or adjacent second seals 61, and are bounded by portions of the second and third flexible material layers 14, 16 disposed between the adjacent first and second seals 60, 61 and/or adjacent second seals 61. The portions of layers of flexible material disposed between adjacent ones of the first seals 60 and adjacent first and second seals 60, 61 are configured to separate upon expansion of the respective expansion chamber. For inner expansion chambers 24, prior to expansion, the first and second layers of flexible material 12, 14 are in close proximity and can, be in contact in an unexpanded state. In such an unexpanded state, there is a relatively small volume $V_{inner1}$ between the first and second flexible material layers 12, 14. Upon expansion, the first and second material layers 12, 14 separate to a larger expanded volume $V_{inner2}$ as compared to the deflated state. Similarly, with the outer expansion chambers 26, prior to expansion, the second and third flexible material layers 14, 16 are in close proximity and can, in embodiments, be in contact. In such an unexpanded state, there is relatively small volume $V_{outer1}$ between the second and third flexible material 14, 16. Upon expansion, the second and third flexible material layers 14, 16 separate to a larger expanded volume $V_{outer2}$ as compared to the deflated state.

Any suitable number of second seals 61 can be disposed between adjacent ones of the first seals 60 to define any suitable number of outer expansion chambers 26 that are disposed within the bounds of the respective inner expansion chamber 24 bounded by the adjacent ones of the first seals 60. For example, in FIG. 3A, two outer expansion chambers 26 are disposed within the bounds of a single inner expansion chamber. In embodiments, the package 10 or a portion of the package 10 can include 1, 2, 3, or 4 or more outer chambers disposed within the bounds of a single inner expansion chamber. At a minimum one of the outer expansion chambers 26 is defined within the bounds of a single inner expansion chamber 24. In such embodiments of a 1:1 ratio of outer expansion chambers 26 to inner expansion chambers 24, the outer expansion chambers 26 are defined between the same adjacent first seals 60 as the inner expansion chambers 24, with the outer expansion chambers 26 being bounded by the third and second flexible material layers 14, 16 and the inner expansion chambers 24 being bounded by the first and second flexible material layers 12, 14. Different regions of the package can have different ratios of outer expansion chambers 26 bounded by a single inner expansion chamber 24. FIG. 5A illustrates an embodiment with a central portion 23 of 1:1 ratio chambers, while other regions have a ratio of outer expansion chambers 26 bounded by inner expansion chambers 24 of 2:1 and even 3:1. In the embodiment illustrated in FIGS. 4A and 5C, the 1:1 ratio chamber set in the central portion 23 is arranged horizontally along a length of the package, but other arrangements and shapes of the 1:1 ratio chamber set in the central portion 23 shapes. In the embodiments shown in FIG. 5B, the inner and outer expansion chambers 24, 26 in the central portion 23 can be disposed within a frame-like structure formed from the cooperation of the inner expansion chambers 24 and outer expansion chambers 26 disposed on the panel. In the alternative or in addition to, the inner and outer expansion chambers 24, 26 in the central portion 23 can extend vertically and/or have a combination of chambers that extend vertically and ones that extend horizontally. Any number and arrangement of the inner and outer expansion chambers 24, 26 in the central portion 23 can be used.

Referring to FIG. 5A, the central portion 23 is illustrated as having only visually apparent outer expansion chambers 26. This can be accomplished by one or both of not inflating the inner expansion chambers 24, or expanding the inner expansion chambers to a lower pressure than the outer expansion chambers 26 such that the greater expansion pressure of the outer expansion chambers 26 results in inner chambers being drawn towards the outer expansion chambers 26 as opposed to expanding towards the product receiving chamber 28.

Alternatively, the central portion 23 can have outer expansion chambers 26 and inner expansion chambers 24 in ratios of other than 1:1. In alternative embodiments, one or more inner expansion chambers 24 can be included in the central portion 23 and can be expanded to a sufficient pressure relative to the outer expansion chamber to expand towards the product receiving chamber 28.

For example, the maximum number of outer expansion chambers bounded by a single of inner expansion chamber can be dependent upon the diameters of the respective chambers and the burst value, which relates to the film material properties. For example, film materials have a given strength value, which will determine the largest chamber diameter that can sustain an expansion pressure without bursting. The larger the diameter the larger the hoop stress, which results in reduced burst value for a given film material. In embodiments, the ratio of outer expansion chambers 26 within a single inner expansion chamber 24 is 20:1 to 1:1, 15:1 to 10:1, 5:1 to 1:1, 3:1 to 1:1. In embodiments, the ratio of inner expansion chambers 24 within a single outer expansion chamber 26 is 20:1 to 1:1, 15:1 to 10:1, 5:1 to 1:1, 3:1 to 1:1. The ratios disclosed above are by means of example only and other suitable ratios are contemplated herein. Choosing different ratios can allow for different shapes.

Additionally, the package can include different ratios of outer expansion chambers 26 to inner expansion chambers 24 in different regions of the package, as noted above.

In some alternatives of the package, each inner expansion chamber 24 can include the same number of outer expansion chambers 26 disposed within the bounds of the inner expansion chamber 24. Inner expansion chambers 24 can include different numbers of outer expansion chambers 26 disposed within the bounds of the outer chamber. For example, a first inner expansion chamber 24 disposed on the front panel can include two outer expansion chambers 26 disposed within its bounds, while a second inner expansion chamber 24 disposed on the side panel can include a single outer expansion chamber 26 within its bound. Any suitable arrangements can be used, including any number of inner expansion chambers 24 and outer expansion chambers.

Figure 2A:
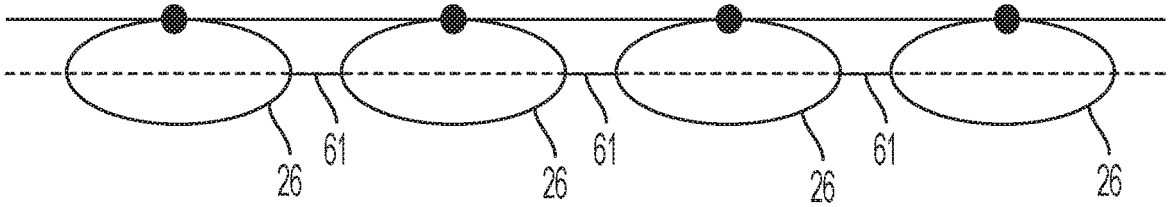
FIGS. 2A-2C are a schematic drawing of inner and outer expansion chambers of packages illustrating the effect of different contact points.
Figure 2B:
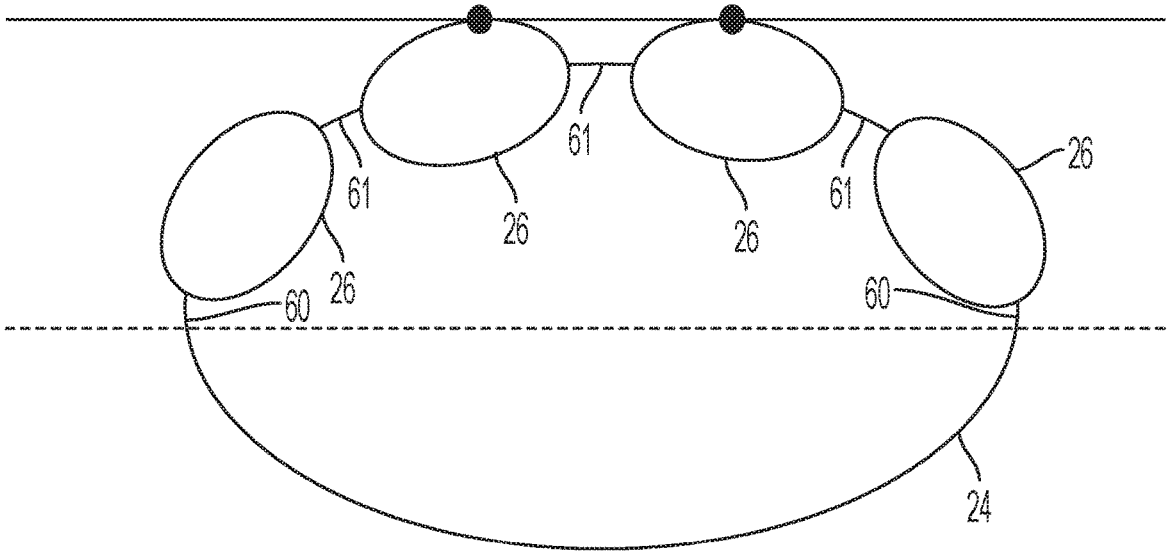
Figure 2C:
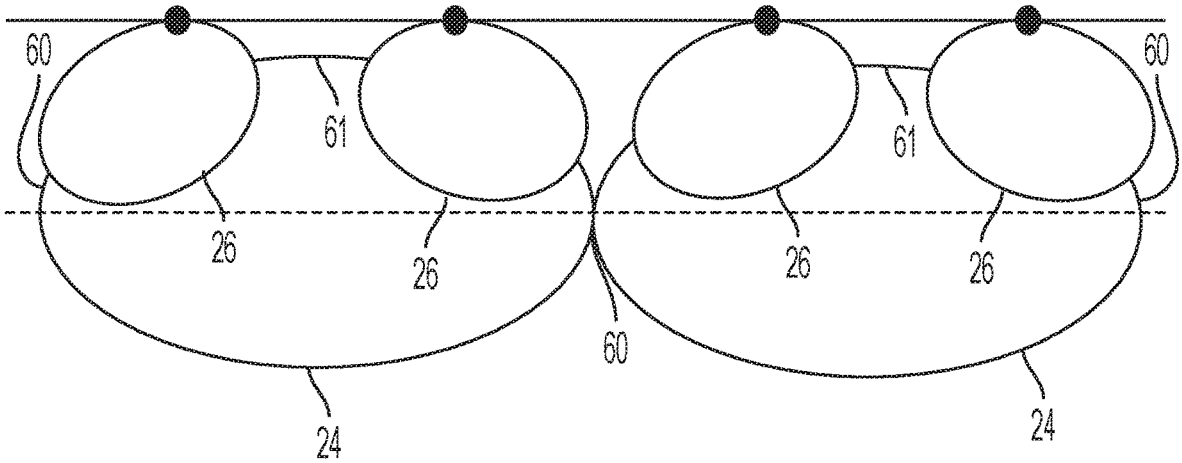

In one or more regions of the package, such as the primary conveying panel, the inner and outer expansion chambers 24, 26 can be utilized to tailor the planar nature and/or points of contact of a given panel. FIGS. 2A to 2C, illustrate how cooperation of the inner and outer expansion chambers can tailor the resulting exterior surface features of the package. FIG. 2A illustrates a set of four outer expansion chambers, each outer expansion chambers being bounded by two seals. In the illustration of FIG. 2A, there is no inner expansion chamber 24 present. FIG. 2A illustrates that when no inner expansion chamber 24 is present, the expansion of the four outer expansion chambers 26 expands the chambers uniformly about a centerline into an elliptical shape as a result of bounding by the opposed seals. The set of four outer expansion chambers 26, assuming equal diameters and pressurization, remain inline, and maintain four points of contact.

FIG. 2B illustrates the effect of adding an inner expansion chamber 24 bounded by outermost seals of the set of four outer expansion chambers 26, these two outermost seals becoming first seals 60. When expanded, the inner expansion chambers expand around a center line forming an elliptical shape due to the bounding of the first seals 60. This results in outer expansion chambers 26 being pushed outward conforming to the shape of the inner expansion chamber 24. In this configuration, the outer surface of the package only has two points of contact with a surface, which can leave it susceptible to rocking or rolling when resting on a planar surface.

Referring to FIG. 2C, by adding another first seal 60, and constraining the inner expansion chamber 24 at a midpoint and creating two inner expansion chambers, each having two outer expansion chamber 26 per inner expansion chamber, the outer surface is pulled inwardly, realigning the outer expansion chambers 26 to again have four points of contact.

Various arrangements of inner and outer expansion chambers, with different ratios of outer to inner expansion chambers can be used throughout the package to generate different localized regions of bowing and/or planarity as illustrated by the example of FIGS. 2A-2C.

The third flexible material layer 16 can be tensioned such that the inner expansion chamber 24 expands inwardly toward the product receiving chamber 28 and draws inwardly the third flexible material layer 16 including the flat film section 63 and the outer expansion chambers 26. This in turn can aid in flattening the respective panel on which the outer expansion chambers 26 are disposed. This can also improve the amount of contact the respective panel has with an underlying surface, which can help improve conveying and prevent rolling during handling. It has been advantageously found that controlling the relative size of the inner expansion chamber 24 with respect to the size of the outer expansion chamber 26 contained within the bounds of the inner expansion chamber 24 can be used to adjust the amount of tension that is on the respective panel. This in combination with selection of the arrangement of the expansion chambers can be used to define how much and what portions of the flexible material layers on a respective panel are pulled inwardly toward the interior volume of the package. The arrangement of the inner and outer expansion chambers 24, 26, including the amount and spacing between outer expansion chambers 26 disposed within the bounds of a single inner expansion chamber 24 can also be used to tailor the surface characteristics of the package 10 or a respective panel.

The width of the first and/or second seals 60, 61 can be used to define the spacing between the outer expansion chambers 26, as well as the width of a flat film section 63 appearing between outer expansion chambers 26. Such spacing and arrangement of the seals could also be arranged in various packages of the disclosure to provide a seal area for a label, such as a mailing label or product indicia label.

The inner expansion chambers 24 can expand such that they extend into or toward the product receiving chamber 28. In such embodiments, upon expansion, the inner expansion chambers 24 can reduce the volume $V_{PRC2}$ of the product receiving chamber 28 as compared to the volume $V_{PRC1}$ of the product receiving chamber 28 prior to expansion of the inner expansion chambers 24, thereby securing a product contained in the product receiving chamber 28.

An inner expansion chamber 24 can have one flexible material layer in common with one or more outer expansion chambers 26. The shared flexible material layer can define an outer portion 81 of the perimeters of the inner expansion chamber 24 and the one or more outer expansion chambers 26, and respective inner portion 83 of the perimeters of the inner expansion chamber 24 and the one or more outer expansion chambers 26. In such embodiments, the outer expansion chambers 26 can be disposed entirely within the inner portion 83 of the perimeter of the inner expansion chamber 24 in both the expanded and deflated states. In effect, the outer expansion chambers 26 when expanded effectively reduce the volume of the inner expansion chamber 24. For example, the inner expansion chamber 24 can have a first expanded volume $V_{inner2'}$ when the one or more outer expansion chambers 26 are in a deflated state that is larger than a second expansion volume $V_{inner2}$ when the one or more outer expansion chambers 26 are in an expanded state. That is, in the expanded state, the outer expansion chambers 26 extend into the volume of the inner expansion chambers 24, consuming volume that otherwise was available to the inner expansion chamber 24 when the outer expansion chambers 26 were in the deflated state.

The diameter of the chambers can also be utilized to control the planarity of the surface. As illustrated in FIGS. 2A-2C, inner and outer expansion chambers 24, 26 which are constrained at two points by first and/or second seals, expand to an elliptical shape about a central line, with the height relative to that center line defining the amount of outward expansion of the chamber. Thus, differences in outer expansion chambers 26 sizing can be used to control which chambers have points and/or lines of contact with a surface. For example, a frame-like outer expansion chamber 26 arrangement can be selected to have a larger diameter to have a height expansion height than adjacent outer expansion chambers 26 so that frame-like structure has contact with the surface.

Figure 4A:
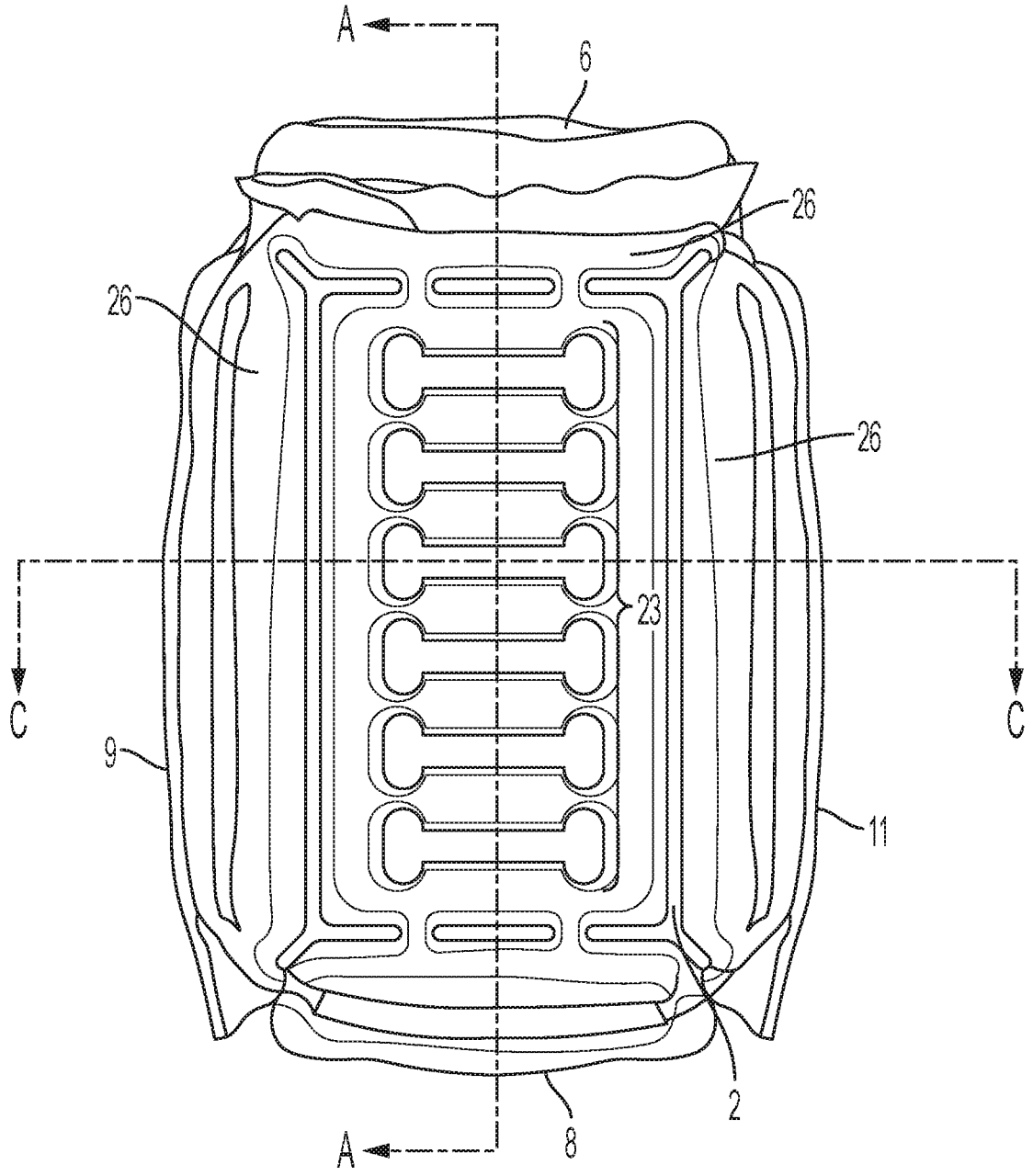
FIG. 4A is a front panel view of a package in accordance with embodiments of the disclosure.
Figure 4B:
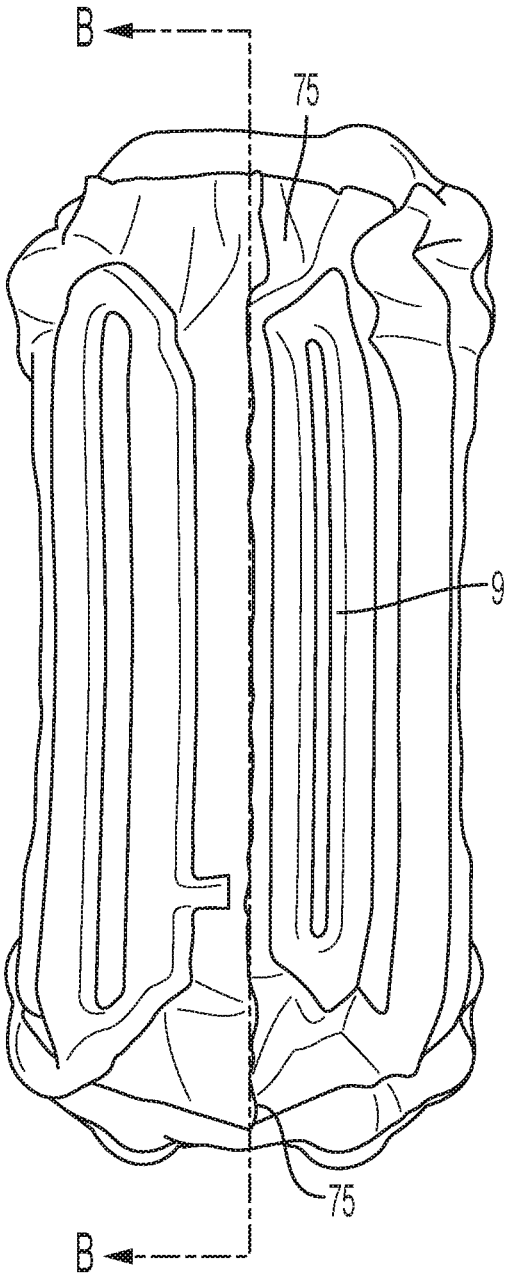
FIG. 4B is side view of the package of FIG. 4A.
Figure 4C:
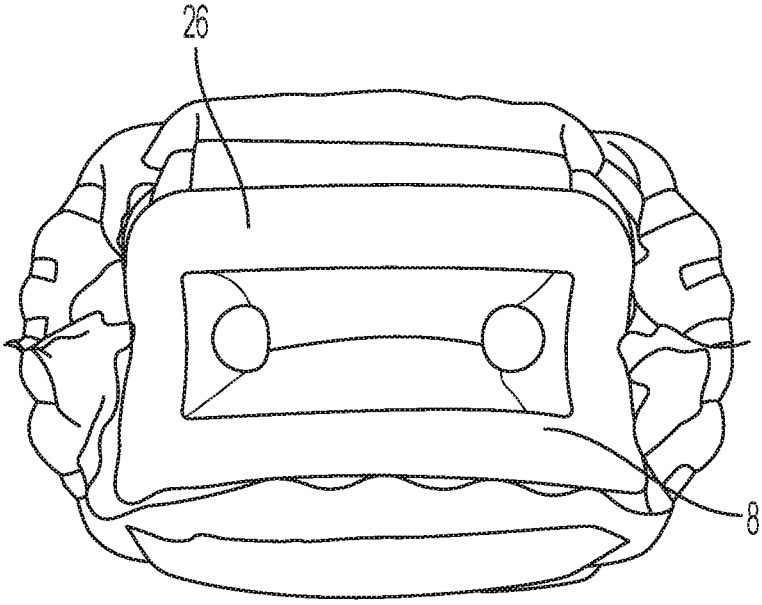
FIG. 4C is a bottom view of the package of FIG. 4A.
Figure 5C:
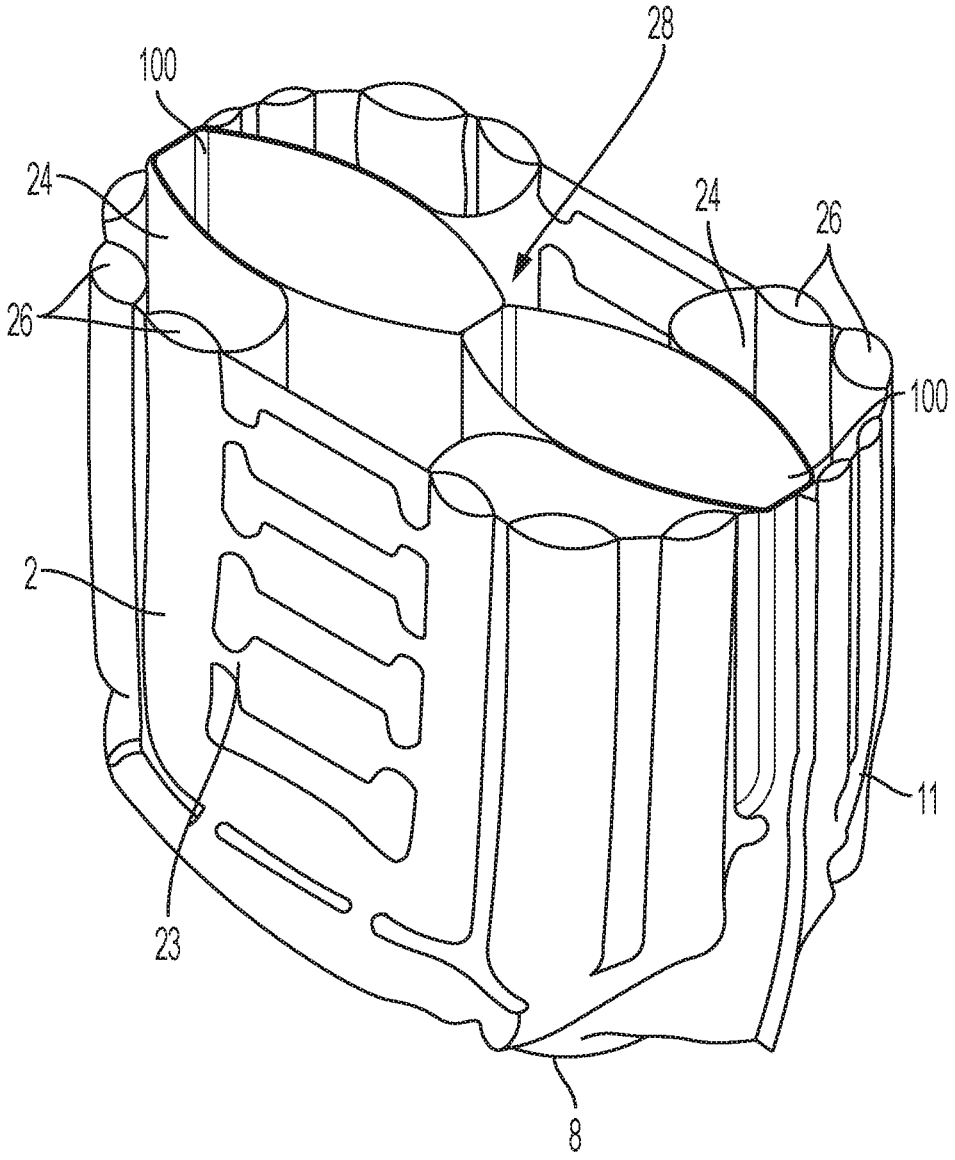
FIG. 5C is a cross-sectional view of the package of FIG. 4A, taken through line 5C-5C in FIG. 4A.

In various packages, the first and second sets of expansion chambers can be fluidly coupled so that portions of or all of the inner and outer expansion chambers can be expanded by introduction of expansion material in one or more fluidly coupled ports. As illustrated in FIG. 4A, the transition between inner and outer expansion chambers, for example, the vertical and horizontal chambers, can be tailored to control the expansion height and the relative surfaces of contact. In the package illustrated in FIG. 4A, the horizontally arranged inner and outer expansion chambers 24, 26 are tapered at the ends as they transition into the vertically arranged inner and outer expansion chambers 24, 26, which can aid in preventing bulging at the transition points to keep the points of contacts at the frame structure.

In embodiments, the inner and outer expansion chambers can be formed by first forming the second seals 61 between the third and second flexible material layers 14, 16. The first flexible material layer 12 can then be added and first seals 60 can be formed by sealing the first flexible material 12 to one or more existing second seals 61 and/or by sealing the first, second, and third flexible material layers 12, 14, 16 together in an unsealed portion.

Flexible shipping packages, as described herein, may be used across a variety of industries for a variety of products. For example, flexible packages, as described herein, may be used for shipping across the consumer products industry, including but not limited to the following products: cleaning products, disinfectants, dishwashing compositions, laundry detergents, fabric conditioners, fabric dyes, surface protectants, cosmetics, skin care products, hair treatment products, soaps, body scrubs, exfoliants, astringents, scrubbing lotions, depilatories, antiperspirant compositions, deodorants, shaving products, pre-shaving products, after shaving products, toothpaste, mouthwash, personal care products, baby care products, feminine care products, insect repellants, foods, beverages, electronics, medical devices and goods, pharmaceuticals, supplements, toys, office supplies, household goods, automotive goods, aviation goods, farming goods, clothing, shoes, jewelry, industrial products, and any other items that may be desirable to ship through the mail or other parcel services, etc. For example, the flexible packages may be used as primary product packaging that can optionally be shipped. For example, the flexible packages can be product packaging that is designed to be packaged in additional shipping packaging if shipping is required. For example, the flexible packages can be ship in own containers that serve both as shipping and product packaging.

Figure 6:
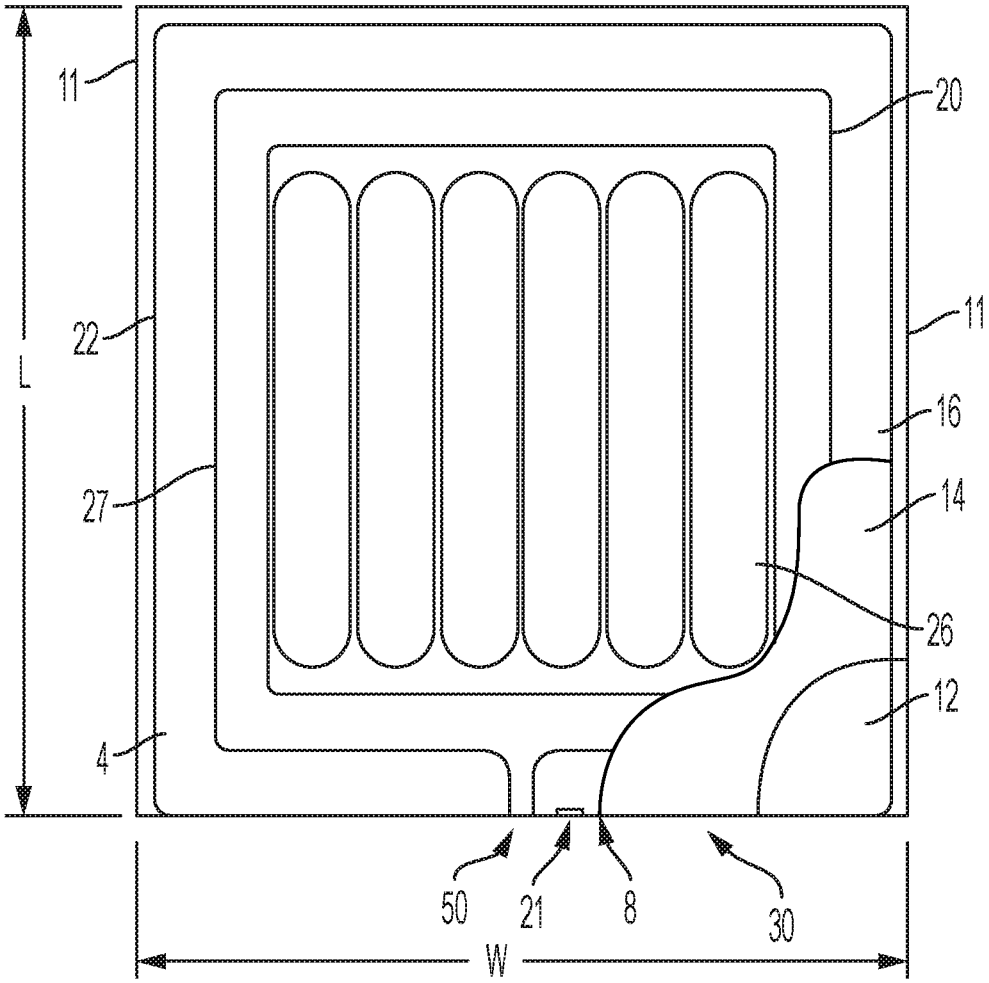
FIG. 6 is a back view of a flexible package in accordance with embodiments of the disclosure, shown in an expanded state.

Referring to FIG. 6, the flexible package 10 may include one or more expansion ports 50. An expansion port 50 may be provided to allow a user to direct an expansion material into one or more of the expansion chambers 24, 26. The expansion port 50 may be an opening between layers of the materials forming the package 10 or may be opening in any one or more layers that provides fluid communication to one or more of the expansion chambers 24, 26. In one example, a portion of the first, second and third flexible material layers 12, 14, 16 remain unjoined along a portion of the primary expansion chamber seam 20 to allow the user to introduce an expansion material into the expansion chambers. Additionally, or alternatively, materials or structures can be placed in desired locations between the sheets and/or layers to provide the expansion port 50. For example, a valve may be located between two of the sheets before or after they are joined to provide the expansion port 50 through which an expansion material may be introduced into one or more of the expansion chambers 24, 26.

Any one or more expansion ports 50 may be in fluid communication with any one or more of the expansion chambers 24, 26 and multiple expansion ports 50 may be in fluid communication with any one or more expansion chambers 24, 26. For example, it may be desirable for a single expansion port 50 to allow for introduction of an expansion material into all of the expansion chambers 24, 26 in the package 10. It may also be desirable for a single expansion port 50 to allow for introduction of an expansion material into only some of the expansion chambers 24, 26 in the package 10, such as for example those on one side of the package 10 or those formed between only the same sheets (e.g. inner sheet 12 and outer sheet 14). Further still, several expansion chambers 24, 26 may have different expansion ports 50 to allow for individual expansion of the chambers 24, 26. Individual expansion can be beneficial when different expansion pressures are desired for different expansion chambers 24, 26 and/or if the expansion chambers 24, 26 will be expanded at different times or with different equipment.

Typically, after the user introduces the expansion material through the expansion port 50, the expansion port is temporarily or permanently closed to prevent the escape of the expansion material(s) from the expanded chamber(s) 24, 26. A pressure source may remain in fluid communication with the expanded chamber 24, 26 throughout an operation that closes the expansion port 50 to help maintain the desired pressure in the expansion chamber 24, 26. Any means can be used to close the expansion port, including those described herein with respect to making chamber seams 20 and 27 as well as any other method suitable for closing the particular expansion port 50 that is used. The expansion port 50 may be hermetically sealed closed or not, depending on the desired end use of the package 10.

In any configuration, it may be desirable to include one or more vents 21 (e.g. shown inn FIG. 6) in fluid communication with the product receiving chamber 28 to allow the vacuum to be applied and/or to allow fluid to escape the product receiving chamber 28 during or after the expansion of the primary expansion chamber(s) 24. The vent 21 can be sealed after the package is fully constructed or it can remain partially or fully open to allow for fluid flow into and/or out of the product receiving chamber 28. The vent 21 can be configured to be self-sealing or can be sealed by some separate step and/or tool. The vent 21 can, for example, include a valve and can be one-way or two-way. That is, it can allow fluid to flow in both directions (in and out) or just one direction. One or more vents 21 can also be provided to allow fluid flow to or from other portions of the package 10, as desired.

The package 10 includes one or more closeable openings 30 through which one or more articles 100 may be placed into the product receiving chamber 28. The closeable opening 30 is preferably an unjoined portion of the sheets or layers making up the product receiving chamber 28. For example, the first flexible material layer 12 at the top or bottom panel 6, 8 of the package 10 may be left unjoined across all or a portion of the width W of the package 10 to form the closeable opening 30. The closeable opening 30 may be located anywhere on the package 10 and may be configured to best meet the needs of the user. For example, if a larger opening is needed, the closeable opening 30 may be disposed along a side panel 11. Also, the closeable opening 30 may be provided through one or more of the sheets or layers making up the package 10. Thus, for example, any one or more of the first, second, and third flexible material layers 12, 14, 16 may include an opening therethrough to form the closeable opening 30. At a minimum, the closeable opening 30 should provide access to the product receiving chamber 28 prior to being closed. This allows the user to place the one or more articles 100 in the product receiving chamber 28 before shipping.

Figure 7:
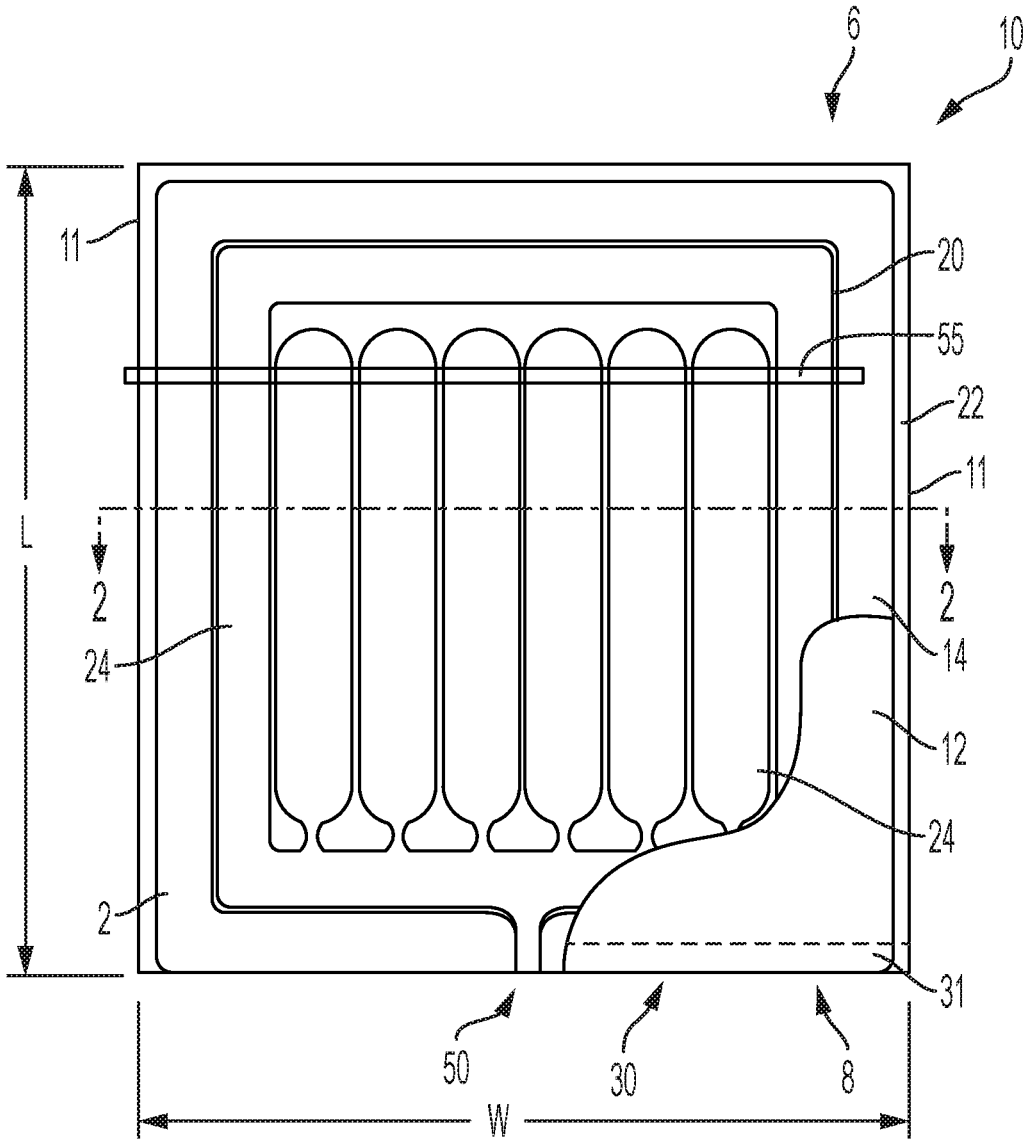
FIG. 7 is a plan view of a flexible package in accordance with embodiments of the disclosure, shown in an unexpanded state.

The closeable opening 30 may be any size desired by the user and can include any type of closure mechanism 31 or material, if a closure mechanism/material is used. For example, the closeable opening 30 may include an adhesive, mechanical closure, magnets, clips, folding closure device or any other closure mechanism desired by the user. As shown in FIG. 7, the closure mechanism 31 can be joined to package 10 at the closeable opening 30 or any other part of the package 10 or may be separate therefrom. The closure mechanism 31 may be a single-use mechanism or may be reusable. Examples of closure mechanisms include, but are not limited to hook and loop fasteners, zippers, buttons, tapes, adhesives, magnetic strips, sewing, string, bands, interference-type fasteners and any other types of closure mechanisms suitable for the particular use of the shipping package 10.

Where a distinct closure mechanism 31 is not used, the closeable opening 30 may be closed by sealing the materials located in the region of the closeable opening 30. Such sealing can be done using heat, chemicals, adhesives, friction, static, sound, or other sources to close the closeable opening 30. It is also possible to provide additional materials in the location of the closeable opening 30 to help provide the desire closure. For example, additional materials with different melting temperatures or strength profiles may be provided. Also, materials like particles, metals, magnets and others may be provided in the area of the closeable opening to allow for sealing of the materials with different equipment and processes. Additionally, or alternatively, the closeable opening 30 may be closed by expanding one or more of the expansion chambers 25 or 26.

The closeable opening 30 may be configured to be reusable (i.e. can be open and closed more than one time) or may be a single-use-type opening. Other features may also be included to help make the package more user-friendly. For example, the closeable opening 30 may be a different color from the rest of the package 10 or may include texture, indicia or other features to make it more readily apparent to the user. Also, the closeable opening 30 may have a sheet, coating or other material therein to help the user open the closeable opening 30 when it is time to insert the article(s) 100.

The closeable opening 30 may be configured such that it can be closed at the same time and/or with the same equipment as one or more of the expansion ports 50. For example, the package 10 can be configured such that the closeable opening can be heat seal closed at the same time one or more of the expansion ports 50 is heat seal closed. Alternatively, the closeable opening 50 can be configured to be closed at a different time than the expansion port(s) 50 and/or by different means. Thus, the article(s) 100 can be placed in the package 100 and the closeable opening 30 be closed at a time different than the expansion of the expansion chambers 24, 26. This may allow for better overall results, for example, if the article 100 must be protected from dust, but the package 10 can't be finally expanded for shipment until a time and/or location different from when and where the article 100 is placed in the package 10. In such situations, the closeable opening 30 can be closed after the article 100 is placed in the article reservoir 28 and need not wait to be closed until the expansion chambers 24, 26 are expanded for shipment.

As shown in FIG. 6, the package 10 may include a handle 5. The handle 5 can provide an additional convenience for the user of the package 10. The handle 5 can act as part of the package 10 for the user to hold, or can act as a hanger or other handling feature to help the user pick up, carry, move, orient, hang, position or otherwise handle the package 10. The package 10 can have any number of handles 5 and the one or more handles can be integral with any one or more of the sheets forming the package 10. Alternatively, or in addition, the handle 5 may include one or more materials added to the package 10 and may be operatively associated with one or more features of the package 10 such as the article retrieval feature 55, the article reservoir 28, a deflation feature or any other feature of the package 10.

The package 10 may include one or more article retrieval features 55, as shown in FIG. 7. The article retrieval feature 55 is used to open the package 10 so that the end user can retrieve the article(s) 100 from the article reservoir 28. The package 10 may include any desired number of article retrieval members 55 and they can be located anywhere on the package 10. Typically, only a single article retrieval feature 55 is necessary, but there may be some situations where two or more are desired to make the package 10 easier to use and/or to allow for retrieval of articles 100 from different product receiving chambers 28 or different regions of the product receiving chamber 28. The article retrieval feature 55 may comprise any element, means, structure, or the like that can be used to open the package and allow the user to gain access to the article(s) 100 in the article reservoir 28. Examples of article retrieval features 55 include, tear strips, zippers, lines of weakness, perforations, sharp tools, and other devices that can be used to open the package 10.

It may be desirable that the article retrieval feature 55 forms part of the package 10 so that no additional tools are needed to access the article(s) in the article reservoir 28. Alternatively, a tool that can be used to open the package 10 can be attached to the package 10, disposed in the package 10, made part of the package or otherwise provided for ease of opening such packages 10. The tool, if used, can be reusable, disposable or single-use.

It may also be desirable that the article retrieval feature 55 be operatively associated with one or more of the expansion chambers 24, 26. That is, when the package 10 is opened using the article retrieval feature, one or more of the expansion chambers 24, 26 are also opened, allowing the expansion material to escape. This configuration may be preferred when the end user intends to deflate or return the package 10 to its unexpanded state once the article 10 is retrieved. The article retrieval feature 55 can be operatively associated with one or more of the expansion chambers 24, 26 to provide for immediate or extended release of the expansion material. Further, the article retrieval feature can be configured to release the pressure or deflate one or more of the expansion chambers 24, 26 at a different time than one or more of the other expansion chambers 24, 26 and/or at any time during the package opening or article retrieval process.

The article retrieval feature 55 may be configured to permanently destroy the package 10 or any part thereof. For example, the article retrieval feature may, when deployed, render the package 10 unfit for re-use. This could be due to tearing of some part of the package 10 or by otherwise rendering one or more of the expansion chambers 24, 26 or the product receiving chamber 28 unusable. Alternatively, the article retrieval feature 55 can be configured to be reusable and allow for the package to be reused as a shipping package 10. One example includes providing a sticker or other cover material over a hole in one or more of the expansion chambers 24, 26 that can be removed to release the expansion material 25.

The package 10 may include a dispenser which can be configured to dispense one or more products from one or more of the product receiving chambers 28 disposed within the package 10. The dispenser may be disposed anywhere on the package 10, as desired and can take on any form such as an opening, a nozzle, a spout, a sprayer, a unit dose dispenser, a trigger dispenser or any other desired dispenser.

One feature that can help reduce the amount of material used in the package 10 and help reduce the overall size of the package 10 is to separate the front panel 2 and the back panel 4 from each other such that they are spaced apart when the package 10 is expanded for use. As described above, one way to do that is to provide sides 9 and 11 and top and bottom panels 6 and 8 between the top panel 2 and bottom panel 4. Top and bottom panels 6 and 8 may be provided by folding the sheets of material making up the package 10 in a configuration to form gussets 75, such as those shown in FIG. 14. For example, the material forming the top and bottom panels 6 and 8 is folded inwardly and while folded, joined by gusset seams 73 or otherwise held in place relative to the side panel 9 or 11 that it touches. In the embodiment shown, the top and bottom panels 6 and 8 each have a gusset panel 77 that is joined to the sides 9 and 11 along the gusset seams 73. This creates the gusset 75 that separates the front panel 2 from the back panel 4 and allows the package to have one or more top and bottom panels 6 and/or 8 that are generally parallel to each other and generally perpendicular to the front panel 2 and back panel 4. The sides 9 and 11 can be extensions of the front panel 2 and back panel 4 and are held in a generally perpendicular orientation to the front panel 2 and back panel 4 by the gusset seams 73. Of course, this is merely one exemplary embodiment used to explain how the package 10 may be configured to provide the desired shape. Other configurations are also contemplated that include other types of gussets 75, different folding patterns and/or different orientations of the panels and sides of the package 10 with respect to each other.

As noted above, one often desirable feature of a shipping package is for it to have a stable base onto which it can be placed. One way to ensure that a stable base 78 is provided, for example on the back panel 4, is to ensure that the base 78 is that part of the package 10 that extends a greater distance from the central plane CP than any other portion of the bottom panel 4. Specifically, as shown for example, in FIGS. 2 and 9, it may be desirable that the base 78 extends from the central plane CP a distance, base distance BD, and preferably the maximum base distance BD, that is greater than the distance, central region distance CRD, and preferably the maximum central region distance RCRD, that the back panel central region 76 extends from the central plane CP. The same can be done with the front panel surface 80 or any other panel of the package 10. For example, it may be desirable to ensure that the front panel surface 80 extends a greater distance from the central plane CP than any other portion of the front panel 2. Specifically, it may be desirable that the front panel surface 80 extends from the central plane CP a distance, top surface distance TSD, and preferably a maximum top surface distance TSD that is greater than the distance, top panel central region distance TCRD, and preferably the maximum top panel central region distance TRCD that the top panel central region 82 extends from the central plane CP.

Figure 8:
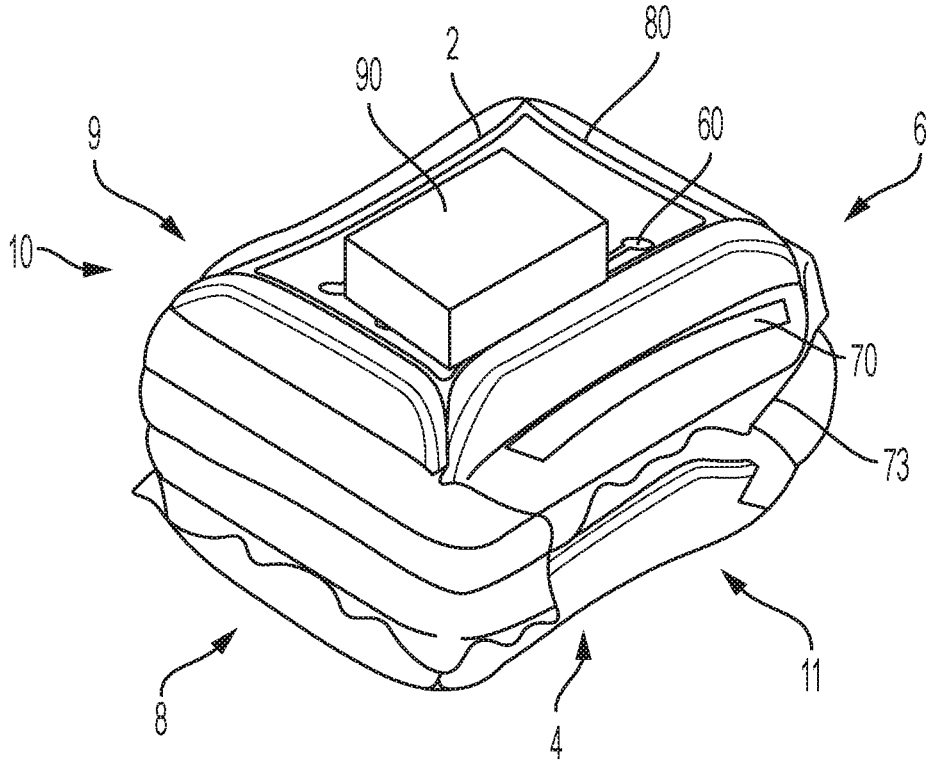
FIG. 8 an isometric view of a package in accordance with embodiments of the disclosure.
Figure 9:
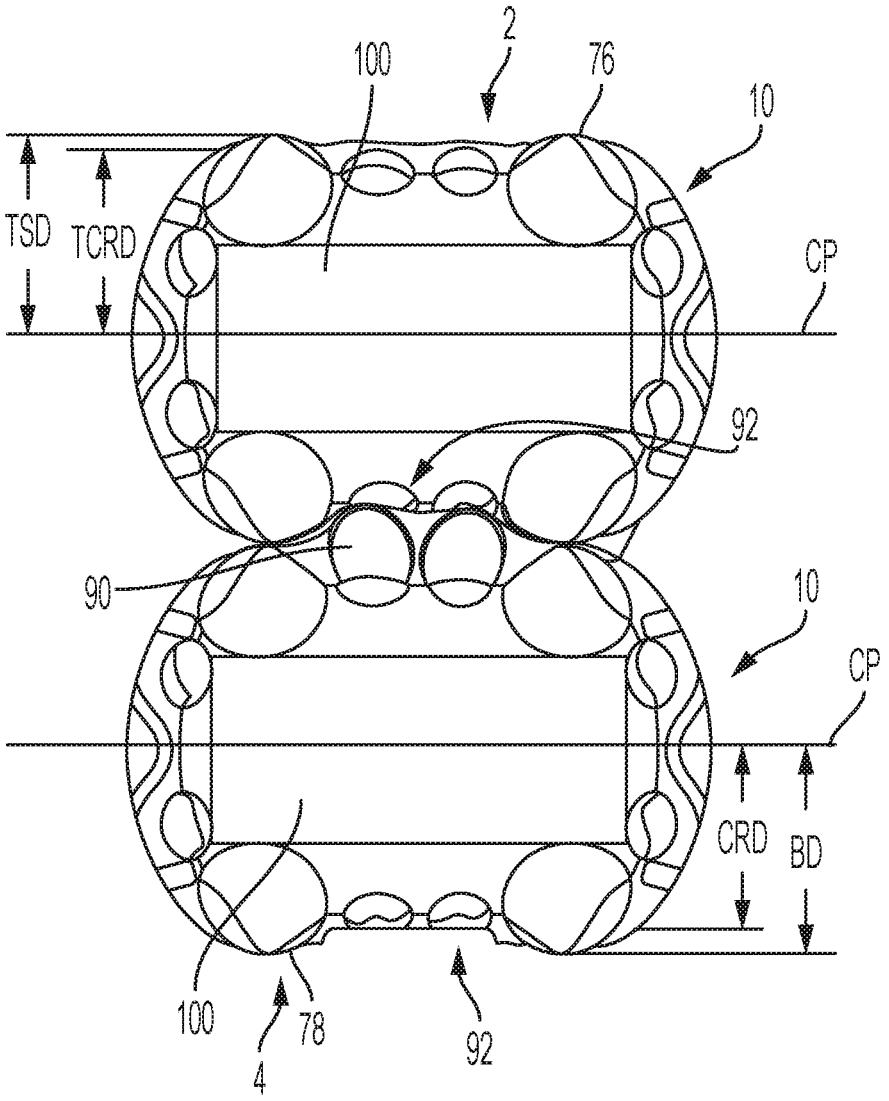
FIG. 9 is a cross-sectional view of two stacked packages in accordance with embodiments of the disclosure.

Another feature that may be desirable for certain packages 10 is a structure that provides for nesting of one or more surfaces of the package 10 with other surfaces and/or other packages 10. For example, it may be desirable the that front panel 2 of one package is configured to nest with the back panel 4 of another package or packages. By nesting, it is meant that a structural feature of one article (e.g. package 10) is able to fit within or otherwise interact with a structural feature of another article (e.g. another package 10 or a surface) in a predetermined way so as to improve how the two articles fit together or coexist in a particular space. Nesting can allow for reduced space needed for shipping or storing multiple packages, can help keep packages 10 from shifting, moving or falling, and can help ensure packages 10 are oriented as desired with other packages 10 or surfaces, etc. Nesting can be realized by shaping one or more of the surfaces or panels of the package 10 to deliberately interact with another surface, article or package. For example, the front panel 2 of the package 10 may be shaped to nest with the back panel 4 of another package 10. Alternatively, or in addition, other sides, ends or panels of the package may be configured for nesting. One example of a package 10 configured for nesting is shown in FIGS. 8 and 9. As shown, the front panel 2 includes a protruding expansion chamber 90 that extends beyond the top surface 80 of the top panel 2. In the embodiment shown, the protruding expansion chamber 90 is generally in the shape of a rectangular parallelepiped extending outwardly from the top surface 80 of the package 10. The same package 10 has an inwardly extending depression 92 disposed on the bottom panel 4 that is sized and shaped such that the protruding expansion chamber 90 can fit at least partially within the depression 92. Of course, any side, end or panel can have one or more protrusions 90 or depressions and the protrusions 90 and depressions can have any desired shape, height or depth.

As noted above, at least one expansion port 50 is in fluid connection with at least one expansion chambers through which an expansion material 25 can be introduced into the expansion chamber. In addition, the package 10 includes at least one opening 30 into which the one or more articles 100 may be inserted is provided. The opening 30 extends from an exterior of the package 10 to the article reservoir 28 and is preferably closeable. The opening 30 can be permanently closeable or can be reopenable. The opening 30 can be closed for example, with a fastener, closed as a result of expanding one or more of the expansion chambers or closed by any other known structure or means including adhesives, filaments, magnets, static, friction, chemical or mechanical bonding, or any combination thereof.

As noted above, the shipping package 10 may optionally include one or more retrieval features 55 such as a tear strip or any other feature that allows a user to access the article reservoir 28 after it has been closed. The retrieval feature 55 may be configured to allow access to the article reservoir 28 without otherwise affecting the package 10 or may be configured to deflate any one or more of the expansion chambers. The retrieval feature(s) 55 can be configured to provide access to the article reservoir 28 at least partially across one side, end or panel or may extend fully across any one or more ends, sides or panels. For example, the retrieval feature(s) 55 may allow access to the article reservoir 28 on three sides, allowing the package 10 to be fully opened like a clam shell, on all sides and edges to allow the top panel 2 and bottom panel 4 to be completely separated from each other, or on one or two sides or edges to allow access more like an envelope or pouch.

The package 10 can be made from a variety of materials. Such materials may include, for example and without limitation, films, woven materials, non-woven materials, paper, foil, and/or any other flexible materials. In fact, an advantage of the package 10 of the present invention is that it can be made substantially, almost entirely or entirely from flexible materials but still provide the rigidity, strength and protection needed to successfully and economically ship consumer products through established parcel and mail delivery systems. For example, the package 10 may comprise or be manufactured only of one or more film materials without the need for additional rigid interior or exterior elements, such as wood, metal, solid foam or rigid plastic or a paperboard box, to provide shape and/or structure to the package 10. Stated differently, the package 10 may consist of, or consist essentially of flexible materials. This can be advantageous for both manufactures and consumers as flexible materials such as sheets of film are often easier to handle, ship and store than more bulky items like paperboard boxes and other structural packaging members.

If films are used, the films may include, for example, polyethylene, polyester, polyethylene terephthalate, nylon, polyproplyene, polyvinyl chloride, and the like. The sheets may include and/or be coated with a dissimilar material. Examples of such coatings include, without limitation, polymer coatings, metalized coatings, ceramic coatings, and/or diamond coatings. The sheets may be plastic film having a thickness such that the sheets are compliant and readily deformable by an application of force by a human. The thicknesses of the inner, outer and secondary outer sheets 12, 14 and 16, respectively, may be approximately equivalent. Alternatively, the thicknesses of the sheets may be different.

The materials making up the sheets may be laminates that include multiple laminated layers of different types of materials to provide desired properties such as strength, flexibility, the ability to be joined, and the ability to accept printing and/or labeling. The materials, for example, may have a thickness that is less than about 200 microns (0.0078 inches). One example of a film laminate includes a tri-layer low-density polyethylene (LDPE)/Nylon/LDPE with a total thickness of 0.003 inches.

Other types of laminate structures may be suitable for use as well. For example, laminates created from co-extrusion, or coat extrusion, of multiple layers or laminates produced from adhesive lamination of different layers. Furthermore, coated paper film materials may be used. Additionally, laminating nonwoven or woven materials to film materials may be used. Other examples of structures which may be used include, but are not limited to: 48ga polyethylene terephthalate (PET)/ink/adh/3.5 mil ethylene vinyl alcohol (EVOH)-Nylon film; 48ga PET/Ink/adh/48ga MET PET/adh/3 mil PE; 48ga PET/Ink/adh/.00035 foil/adh/3 mil PE; 48ga PET/Ink/adh/48ga SiOx PET/adh/3 mil PE; 3.5 mil EVOH/PE film; 48ga PET/adh/3.5 mil EVOH film; and 48ga MET PET/adh/3 mil PE.

The sheets may be made from sustainable, bio-sourced, recycled, recyclable, and/or biodegradable materials. Non-limiting examples of renewable polymers include polymers directly produced from organisms, such as polyhydroxyalkanoates (e.g., poly(beta-hydroxyalkanoate), poly(3-hydroxybutyrate-co-3-hydroxyvalerate, NODAX™), and bacterial cellulose; polymers extracted from plants and biomass, such as polysaccharides and derivatives thereof (e.g., gums, cellulose, cellulose esters, chitin, chitosan, starch, chemically modified starch), proteins (e.g., zein, whey, gluten, collagen), lipids, lignins, and natural rubber; and current polymers derived from naturally sourced monomers and derivatives, such as bio-polyethylene, bio-polypropylene, polytrimethylene terephthalate, polylactic acid, NYLON 11, alkyd resins, succinic acid-based polyesters, and bio-polyethylene terephthalate.

The sheets making up the package 10 may be provided in a variety of colors and designs, as to appeal to a consumer interested in purchasing the product held in the package 10. Additionally, materials forming the sheets may be pigmented, colored, transparent, semitransparent, or opaque. Such optical characteristics may be modified through the use of additives or masterbatch during the film making process. Additionally, other decoration techniques may be present on any surface of the sheets such as lenses, holograms, security features, cold foils, hot foils, embossing, metallic inks, transfer printing, varnishes, coatings, and the like. Any one or all of the sheets may include indicia such that a consumer can readily identify the nature of the product, or any given property of the product, held in the article reservoir 28 of the package 10, along with the brand name of the producer of the product held in the package 10, the sender of the package 10, or any third-party such as a sponsor of either the producer of the product or the sender of the package 10. The indicia may contain decorative elements. The indicia may also provide comment or instruction on use of the product and/or package 100. In particular, the first surface 17 or the second surface 19 of the outer sheet 14 may be generally flat and free from interruptions. Accordingly, a variety of branded indicia may be applied to the first surface 17 or second surface 19 of the outer sheet 14 of the package 10 for viewing by a shipper or consumer.

Flexible film materials forming the sheets may be colored or pigmented. Flexible film materials may also be pre-printed with artwork, color, and or indicia before forming a package preform using any printing methods (gravure, flexographic, screen, ink jet, laser jet, and the like). Additionally, the assembled package 10 may be printed after forming using digital printing. Any and all surfaces of the package 10 may be printed or left unprinted. Additionally, certain laminates of a laminated film forming the sheets may be surface printed or reverse printed. In addition, functional inks may be printed on the sheets. Functional inks are meant to include inks providing decoration benefits, texture coatings, or other benefits including, for example and without limitation, printed sensors, printed electronics, printed RFID, and light-sensitive dies. Additionally, or in the alternative, labels, for example and without limitation, flexible labeling, or heat shrink sleeves may be applied to the sheets making up the shipping packages 10 or the shipping packages 10 themselves before or after expansion to provide the desired visual appearance of the packages 10. Because films can be printed flat and then formed into three dimensional objects, artwork can be designed to conform precisely to the package 10 itself or articles 100 therein. For example, some or all of the printing may be distorted relative to its desired finished appearance, so that the indicia acquire their desired finished appearance upon being formed into three dimensional objects. Such pre-distortion printing may be useful for functional indicia such as logos, diagrams, bar-codes, and other images that require precision in order to perform their intended function.

A variety of primary expansion materials 25 and/or secondary expansion materials 29 may be provided into the primary expansion chambers 24 and secondary expansion chambers 26, respectively. The primary expansion material 25 and/or secondary expansion material may be a gas, a liquid, a solid or a combination thereof. One example of a solid expansion material is a solidifying foam. Such materials can be introduced into the expansion chambers as a fluid that changes to a solid or as a solid. If a foam is used, it may be an expandable foam that increases in volume as the foam solidifies. An example of such foams includes, without limitation, a two-part liquid mixture of isocyanate and a polyol that, when combined under appropriate conditions, solidify to form a solid foam. The expansion material may include a perfume, scent, color or have other consumer noticeable attributes that can provide aesthetic and/or functional benefits while enclosed within the expansion chambers or when released therefrom. For example, a scent can be included in the expansion material 25 such that when one or more of the expansion chambers is deflated, the scent is released into the air. Further, an expansion material can be used that provides UV protection, insulation or another desirable function.

Expansion of the expansion chambers 24, 26 may be caused by a phase change of a fluid introduced into the chambers. Examples of the phase change may include injecting a quantity of cooled material, for example and without limitation, liquid nitrogen or dry ice. By sealing the chamber from the external environment and allowing the expansion material to vaporize and/or sublimate when reaching an ambient temperature, pressures between the sheets may cause the expansion chambers to expand. Chemically reactive materials, for example and without limitation, a weak acid, such as citric acid, to a weak base, such as sodium bicarbonate, may be introduced into the chambers and can be activated, as desired, by the user. In such configurations, it may not be necessary to have an opening or port into which the user can introduce the expansion materials.

If chemically reactive materials are used, they can be separated from one another to allow the user to determine when to expand the expansion chambers. For example, they can be separated using a frangible seal, which may be broken to induce a reaction that causes expansion of the expansion chambers. Also, chemically reactive materials may be chosen that are non-reactive with one another at certain environmental conditions, for example at certain temperatures. When expansion of one or more of the expansion chambers is desired, the package 10 may be exposed to the environmental conditions, for example, by increasing the ambient temperature, causing the chemically reactive materials to react with one another to cause the expansion. The chemically reactive materials may be non-reactive with one another unless subject to electromagnetic energy including, for example and without limitation UV light or microwave energy. In such cases, when expansion of one or more of the expansion chambers is desired, the package 10 may be exposed to the electromagnetic energy, causing the chemically reactive materials to react with one another to cause the expansion.

Although the expansion material may provide any amount of expansion desired, the it has been found that a pressure from about 1 psig to about 20 psig above ambient is generally suitable for shipping packages 10 used to ship typical consumer products. Higher or lower pressures may be desired in one or all of the expansion chambers 24, 26 depending on the article(s) 100 being shipped, the method of shipment, the expected environmental conditions, such as the temperature and/or altitude to which the shipping package 10 will be exposed.

The packages 10 of the present invention can be configured to have any desired mechanical, chemical, environmental (e.g. temperature, humidity, light, sound, dust, atmospheric pressure, precipitation, etc.), and other performance characteristics desired. For example, the packages 10 may include materials that resist penetration of humidity, water, light, certain chemicals, and/or gases. An advantage of the package 10 of the present invention is that it can be configured to meet or exceed many of the most common parcel shipping requirements, for example, as set for in industry standards like ISTA performance tests, without the need for multiple different packaging materials or difficult to construct and/or store packages.

The package 10 may be configured to endure the rigors of shipping through regions of changing ambient air pressure, such as transportation over mountains or shipment via air-cargo. Changes in ambient pressure may include increases in atmospheric pressure and decreases in atmospheric as well as changes in ambient pressure, such as in pressurized cargo holds. Transportation over high altitudes and/or shipment via air-cargo typically include a reduction in ambient air pressure. Such reductions in ambient pressure can result in an expansion chamber 24, 26 that is expanded to a pressure below its burst pressure at or near sea-level to burst during shipment. The expansion chambers 24 and 26 may be inflated sufficiently below their burst-pressure that they do not burst during shipment at reduced ambient pressure and/or may include vents or valves to allow some or all of the expansion material to escape if the expansion chamber is nearing its burst pressure.

In terms of mechanical protection, the packages 10 may be designed and configured to have properties that help protect any articles 100 shipped therein from damage due to mechanical forces, such as dropping, stacking, puncture, squeezing, tearing, pinching, etc. As with other attributes, the package 10 can be specifically designed to meet the needs of the user in terms of mechanical protection by choosing appropriate materials for different parts of the package 10, appropriately designing the shape of the package 10, appropriately expanding the one or more expansion chambers 24, 26, among other things.

One of the most important mechanical damaging forces to protect against during shipping is dropping. Often packages do not provide adequate protection for dropping because they allow the articles being shipped therein to "bottom out" when dropped. Bottoming out occurs when any protective material in the package reaches its limit of protection and the article therein is subjected to the full resistance force of the surface on which it is dropped. The packages 10 of the disclosure have been found to be particularly good at resisting bottoming out of articles shipped therein, and thus, can effectively prevent breakage and other damage to the articles.

Further, the package 10 may include one or more thermally insulating material. A thermally insulating material is one that would result in an increase of the R-value as measured between the reservoir 28 and the outside of the package. In one example, one or more of the expansion chambers 24, 26 may include a thermally insulating material. Non-limiting examples of thermally insulating materials include foams and gasses with R-values greater than air, such as, for example, noble gases such as argon.

The overall shape of the package 10 may include at least one relatively flat portion or "face". This portion may be useful for applying shipping labels or instructions. Although not required, having a relatively flat portion may be useful in terms of handling the package 10 through conventional shipping systems. For example, when conveying packages at angles, rounded packages have a tendency to tumble, while packages comprising relatively flat portions are less likely to have that disadvantage. The overall shape of the package 10 may be roughly polyhedral. The overall shape of the package may be substantially a rectangular prism. Such shapes can also provide for better stacking, fit into conventional shipping equipment and handling.

Figure 10:
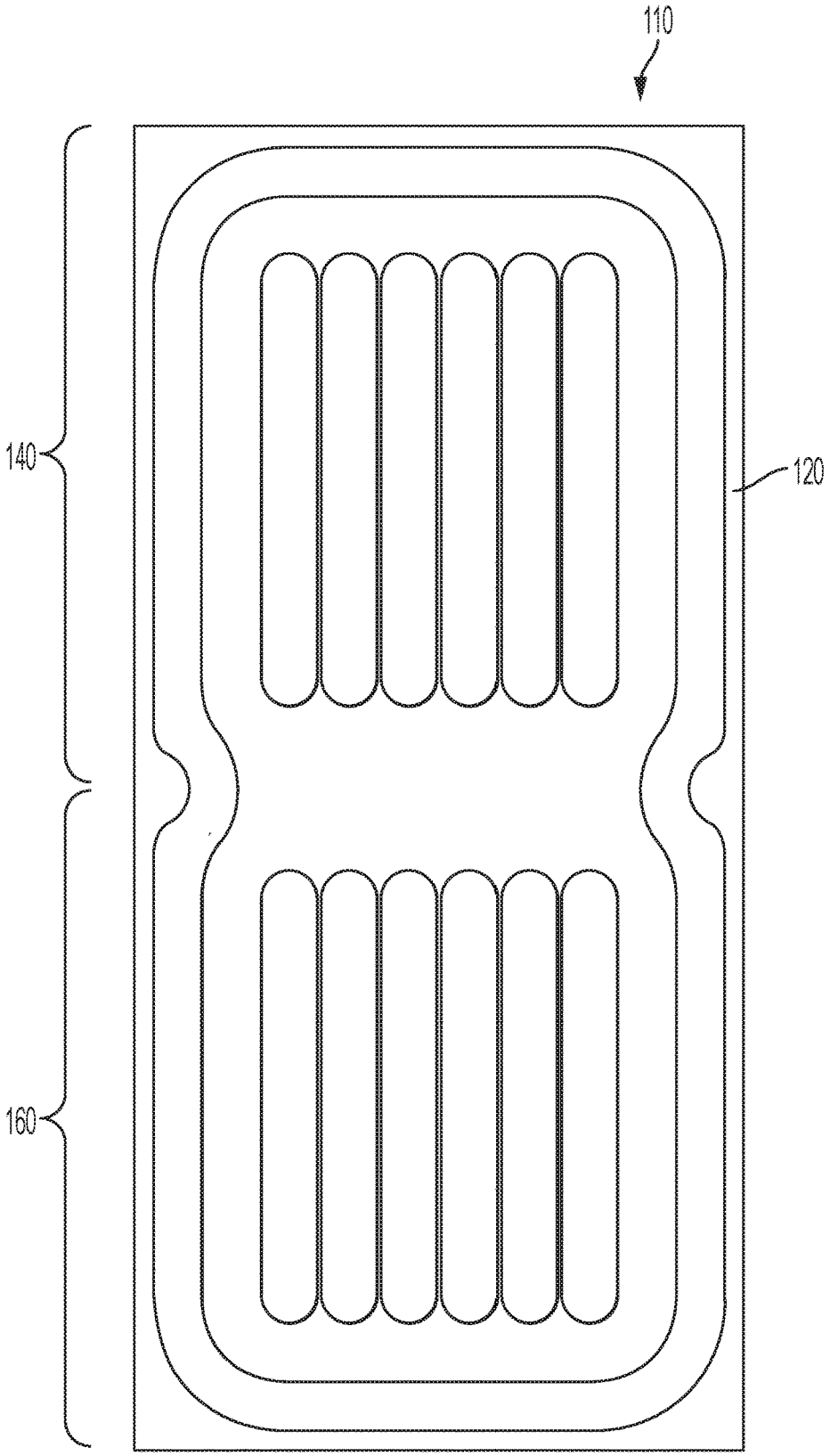
FIG. 10 is a plan view of a preform of a flexible package in accordance with embodiments of the disclosure, before it is assembled into the final package.

Referring now to FIG. 10, a preform 110 of an example of the flexible shipping package 10 of embodiments of the disclosure is depicted before assembly where the flexible material is formed as three-sheet assembly 120, with each sheet defining a flexible material layer discussed above. As shown, first sheet portion 140 and second sheet portion 160 are not yet folded upon each other to form the unexpanded package 10. During assembly, the preform 110 is folded such that first sheet portion 140 and second sheet portion 160 are disposed such that the inner sheet 12 of the first sheet portion is facing and disposed adjacent to the inner sheet 12 of the second sheet portion 160. After being folded, the first sheet portion 140 and the second sheet portion 160 are joined together at exterior seams 22, as shown in FIG. 6. The exterior seam 22 joins the first and second portions 140 and 160 to one another, thereby forming the package 10 having article reservoir 28. The article reservoir 28 is therefore enclosed by the exterior seam 22 between the inner sheet 12 of the first and second sheet portions 140 and 160.

Packages 10 according to the present disclosure may be manufactured according to a variety of methods. For example, the package 10 may be assembled according to the method described below. A first film (the inner sheet 12) and a second film (the outer sheet 14) are placed onto one another. A plurality of primary expansion chamber seams 20 are formed by heat sealing. The primary expansion chamber seams 20 formed by the heat sealing operation define the expansion chamber(s) 24. To further define the expansion chambers 24, the heat seal die may include features that form seals about at any desired thickness, for example, about 0.325 inch thick. Prior to heat sealing, a one-way film valve may be placed between the inner sheet 12 and the outer sheet 14 the film valve spans across a location where the sheets 12 and 14 will have a seam 20. One-way film valves are conventionally known and are described, for example, at U.S. Pat. Pub. No. 2006/0096068. The one-way film valve may include an ink or polymer material on at least a part of the film valve that enables the film valve to be sealed into the seams created by the heat seal die, but without sealing the film valve shut.

A heat seal die may be used to form the seam 20. If so, the die is heated to the desired temperature and pressed against the first and second films 12 and 14 to create the seams 20. The inner and outer sheets 12 and 14 may be positioned relative to the heat seal die a second time to create additional primary expansion chambers 24. If the package 10 includes three or more sheets creating any portion thereof, a heated die can be used to form secondary expansion chambers 26.

After the expansion chamber(s) are formed, the ends and/or sides of the sheets may be joined to form the product receiving chamber 28 and the general shape of the package 10. Air, or another expansion material, may be introduced through the one-way film valve(s) to expand the expansion chamber(s). Air may be introduced at any suitable pressure. For example, air may be introduced at a pressure from about 1 psig to about 20 psig to expand the chamber(s) without risk of rupture of flexible material by overpressure. Further, as noted, other expansion material may be used and the inner expansion chambers 24 and outer expansion chambers 26, if any, may be expanded to different pressures.

A plurality of packages 10 may be formed from larger continuous sheets of material. The packages 10 may be formed simultaneously or in series.

The packages 10 can use any and all materials, structures, and/or features for the packages 10, as well as any and all methods of making and/or using such packages 10, disclosed in the following US patents and applications: (1) U.S. Pat. No. 9,815,258 filed May 7, 2012, entitled "Film Based Packages"; (2) U.S. Publication No. 2013/0292395 A1 filed May 7, 2012, entitled "Film Based Packages"; (3) U.S. Publication No. 2013/0292287 A1 filed Jul. 26, 2012, entitled "Film Based Package Having a Decoration Panel"; (4) U.S. Patent application 61/727,961 filed Nov. 19, 2012, entitled "Packages Made from Flexible Material"; (5) U.S. Pat. No. 10,040,581 filed Aug. 6, 2012, entitled "Methods of Making Film Based Packages"; (6) U.S. Publication No. 2013/0292413 A1 filed Mar. 13, 2013, entitled "Flexible Packages with Multiple Product Volumes"; (7) U.S. Pat. No. 9,469,088 filed Mar. 15, 2013, entitled "Flexible Materials for Flexible Containers" 61/789,135; (8) U.S. Patent Application 62/701,273 filed Jul. 20, 2018 entitled "Adsorbent Matrix as Propellant in Aerosol Package"; (9) U.S. Patent Application 62/783,535 filed Dec. 21, 2018 entitled "Shaped Flexible Shipping Package and Method of Making"; (10) U.S. Patent Application 62/810,987 filed Feb. 27, 2019 entitled "Flexible Shipping Package"; (11) U.S. Patent Application 62/838,955 filed Apr. 26, 2019 entitled "Flexible Shipping Package and Method of Making"; (12) U.S. Patent Application 62/851,224 filed May 22, 2019 entitled "Flexible Package and Method of Manufacture"; (13) U.S. Patent Application 62/851,230 filed May 22, 2019 entitled "Flexible Package and Method of Manufacture"; and (14) U.S. Patent Application 62/864,549 filed Jun. 21, 2019 entitled "Flexible Package and Method of Manufacture"; each of which is hereby incorporated by reference.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A flexible package, comprising:

a plurality of panels that cooperate to define a product receiving chamber having an outer perimeter defined by a first flexible material layer;

a second flexible material layer spaced outbound from the first flexible material layer relative to the product receiving chamber; and a third flexible material layer spaced outbound from the second flexible material layer, the first, second, and third flexible material layers being sealed together in a plurality of discrete locations to define first seals, with a plurality of inner expansion chambers bounded by adjacent ones of the first seals and having an inner expansion chamber volume constrained between the first and second flexible material layers, and the third flexible material layer and the second flexible material layer being sealed together in a plurality of discrete locations to define second seals, with a plurality of outer expansion chambers bounded by adjacent first seals, adjacent first and second seals and/or adjacent second seals, and having an outer expansion chamber volume constrained between the second and third flexible material layers, one or more of the plurality of inner and outer expansion chambers being arranged in a central portion of at least one panel and each of the one or more of the plurality of inner chambers has one outer expansion chamber within its bounds, wherein:

the plurality of inner and outer expansion chambers are adapted to receive an expansion material and expand, and when the plurality of inner and outer expansion chambers are filled with an expansion material to expand the plurality of inner and outer expansion chambers the one or more inner expansion chambers are expanded such that a portion of the one or more inner expansion chambers extends inwardly towards the product receiving chambers, pulling third flexible material layer inwardly towards the product receiving chamber.

2. A flexible package, comprising:

a plurality of panels that cooperate to define a product receiving chamber having an outer perimeter defined by a first flexible material layer;

a second flexible material layer spaced outbound from the first flexible material layer relative to the product receiving chamber; and a third flexible material layer spaced outbound from the second flexible material layer, the first, second, and third flexible material layers being sealed together in a plurality of discrete locations to define first seals, with a plurality of inner expansion chambers bounded by adjacent ones of the first seals and having an inner expansion chamber volume constrained between the first and second flexible material layers, and the third flexible material layer and the second flexible material layer being sealed together in a plurality of discrete locations to define second seals, with a plurality of outer expansion chambers bounded by adjacent first seals, adjacent first and second seals and/or adjacent second seals, and having an outer expansion chamber volume constrained between the second and third flexible material layers, the package having a package height extending between opposed top and bottom panels, a package width extending between opposed first and second side panels, and a package depth extending between opposed front and back panels, the first and second side panels each comprising a gusset, wherein:

the plurality of inner and outer expansion chambers are adapted to receive an expansion material and expand, and when the plurality of inner and outer expansion chambers are filled with an expansion material to expand the plurality of inner and outer expansion chambers the one or more inner expansion chambers are expanded such that a portion of the one or more inner expansion chambers extends inwardly towards the product receiving chambers, pulling third flexible material layer inwardly towards the product receiving chamber.

3. A flexible package, comprising:

first, second, and third flexible material layers, with the second flexible material layer being disposed between the first and third flexible material layers;

a product receiving chamber having a product receiving chamber outer circumference defined by the first flexible material layer;

a plurality of spaced first seals disposed around a package circumference, the first seals sealing the first, second and third flexible material layers together;

a plurality of spaced second seals disposed around the product receiving chamber outer circumference, the second seals sealing the second and third flexible material layers together;

a plurality of inner expansion chambers, each one of the plurality of chambers being defined between adjacent ones of the first seals; and a plurality of outer expansion chambers, each one of the plurality of chambers being defined between adjacent first seals, a second seal and an immediately adjacent first seal, and/or adjacent second seals, wherein:

in at least a portion of the package, at least two second seals are disposed between adjacent ones of the first seals such that at least two outer expansion chambers are defined within one inner expansion chamber, and the plurality of inner and outer expansion chambers are adapted to receive an expansion material and expand, when one or more of the plurality of inner expansion chambers is filled with an expansion material the one or more inner expansion chambers expands such that a portion of the one or more inner expansion chambers extends inwardly towards the product receiving chambers, and when one or more of the plurality of outer expansion chambers is filled with an expansion material, the one or more outer expansion chambers expands such that a portion of the one or more outer expansion chambers extends outwardly away from the one or more inner expansion chambers.

4. The flexible package of claim 3, wherein at least one of the plurality of outer expansion chambers is disposed between adjacent first seals, such that the outer expansion chamber is bounded by the same first seals as one of the plurality of inner expansion chambers.

5. The flexible package of claim 3, wherein at least one of the plurality of outer expansion chambers is disposed between one of the plurality of first seals and an adjacent second seal, such that the outer expansion chamber is disposed between adjacent first seals defining one of the plurality of inner expansion chambers.

6. The flexible package of claim 3, wherein at least one of the plurality of outer expansion chambers is disposed between adjacent ones of the plurality of second seals.

7. The flexible package of claim 3, wherein the plurality of inner expansion chambers and/or outer expansion chambers have a plurality of diameters.

8. The flexible package of claim 3, wherein at least one of the plurality of inner expansion chambers is disposed beneath and partially overlapping with at least one of plurality of outer expansion chambers and the at least one of the plurality of inner expansion chambers is wider than the at least one of the plurality of outer expansion chambers.

9. The flexible package of claim 3, wherein the package has at least three points of contact when resting on a planar or substantially planar surface.

10. The flexible package of claim 3, wherein the package has a package height extending between opposed top and bottom panels, a package width extending between opposed first and second side panels, and a package depth extending between opposed front and back panels.

11. The flexible package of claim 3, wherein one or more of the plurality of inner and outer expansion chambers are arranged in a central portion of at least one panel and each of the one or more of the plurality of inner chambers has one outer expansion chamber within its bounds.

12. The flexible package of claim 11, wherein the one or more of the plurality of inner and outer expansion chambers are arranged in the central portion of the front and/or back panel.

13. The flexible package of claim 3, wherein the one or more of the plurality of inner and outer expansion chambers arranged in the central portion have a length extending along a width of the package.

14. The flexible package of claim 3, comprising a plurality of the one or more of the plurality of inner and outer expansion chambers are arranged in the central portion, being stacked vertically along a height of the package.

15. The flexible package of claim 3, wherein at least a portion of the plurality of outer expansion chambers are disposed on the front and back panels and extend horizontally along the package width and the plurality of outer expansion chambers are aligned vertically along the package height.

16. The flexible package of claim 3, wherein one or more of the plurality of outer expansion chambers are arranged to define a frame having a shape corresponding to a circumferential shape of the panel of the package on which they reside.

17. The flexible package of claim 16, wherein one or more of the plurality of inner expansion chambers are arranged to define a frame having a shape corresponding to the circumferential shape of the front and/or back panel of the package.

18. The flexible package of claim 3, wherein the plurality of outer expansion chambers are arranged to define two or more concentric frames corresponding to the circumferential shape of the panel on which they reside.

19. The flexible package of claim 3, where in one or more of the plurality of outer expansion chambers are disposed in a central portion of the front and/or back panel.

20. The flexible package of claim 19, wherein the one or more of the plurality of outer expansion chambers extend horizontally on the front or back panel of the package.

21. The flexible package of claim 3, wherein the first and second side panels each comprise a gusset.

22. The flexible package of claim 3, wherein the front and/or back panel have at least three points of contact with a planar or substantially planar surface when resting on the surface.

23. The flexible package of claim 22, wherein the front and/or back panel have at least four points of contact with a planar or substantially planar surface when resting on the surface.

24. The flexible package of claim 3, wherein the front and/or back panel have at least one line of contact with a planar or substantially planar surface when resting on the surface.

25. The flexible package of claim 24, wherein the front and/or back panel have at least two lines of contact with a planar or substantially planar surface when resting on the surface.

26. The flexible package of claim 3, further comprising one or more rib expansion chambers.

27. The flexible package of claim 26, wherein the one or more rib expansion chambers are arranged in a central portion of one or more panels of the package.

28. The flexible package of claim 3, wherein the plurality of inner chambers and the plurality of outer chambers are disposed circumferentially around the package.

29. A flexible package, comprising a plurality of panels that cooperate define a product receiving chamber, a plurality of inner expansion chambers spaced outbound from the product receiving chamber;

a plurality of outer expansion chambers spaced outbound from the product receiving chamber;

wherein a relative arrangement of the plurality of inner expansion chambers and outer expansion chambers is selected to provide at least one surface of at least one panel the flexible package with at least three points of contact when the at least one surface is rested on a substantially planar surface, wherein at least two of the plurality of inner expansion chambers are disposed at the at least one panel of the package corresponding to the least one surface, and at least one of the two inner expansion chambers has a ratio of outer expansion chambers within a bound of the inner expansion chamber of at least 2:1.

* * * * *